US006168266B1

(12) United States Patent
Ishinaga et al.

(10) Patent No.: US 6,168,266 B1
(45) **Date of Patent: *Jan. 2, 2001**

(54) INK TANK CARTRIDGE, A MANUFACTURING METHOD THEREOF AND A PACKAGING STRUCTURE OF THE INK TANK CARTRIDGE

(75) Inventors: Hiroyuki Ishinaga, Tokyo; Kazuaki Masuda, Kawasaki; Hajime Kaneko, Kodaira; Yuji Kamiyama, Sapporo, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/719,410

(22) Filed: Sep. 24, 1996

(30) Foreign Application Priority Data

| | | |
|---|---|---|
| Sep. 29, 1995 | (JP) | 7-254064 |
| Sep. 29, 1995 | (JP) | 7-276347 |
| Sep. 29, 1995 | (JP) | 7-276349 |
| Sep. 29, 1995 | (JP) | 7-276350 |
| Sep. 29, 1995 | (JP) | 7-276351 |

(51) Int. Cl.[7] ..... B41J 2/175
(52) U.S. Cl. ..... 347/86
(58) Field of Search ..... 347/85, 86, 87, 347/49

(56) References Cited

U.S. PATENT DOCUMENTS

| | | | |
|---|---|---|---|
| 4,771,295 | 9/1988 | Baker et al. | 347/87 |
| 4,811,887 | 3/1989 | King et al. | 228/2 |

FOREIGN PATENT DOCUMENTS

| | | | |
|---|---|---|---|
| 4328001 | 2/1995 | (DE) | B41J 2/175 |
| 0423374 | 4/1991 | (EP) | B65D 81/16 |
| 0514632 | 11/1992 | (EP) | B41J 2/165 |
| 0523635 | 1/1993 | (EP) | B41J 2/175 |
| 0542247 | 5/1993 | (EP) | B41J 2/175 |
| 0553535 | 8/1993 | (EP) | B41J 2/175 |
| 0562733 | 9/1993 | (EP) | B41J 2/175 |
| 0581531 | 2/1994 | (EP) | B41J 2/175 |
| 0589540 | 3/1994 | (EP) | B41J 2/19 |
| 0627317 | 12/1994 | (EP) | B41J 2/175 |
| 0631874 | 1/1995 | (EP) | B41J 2/175 |
| 0633138 | 1/1995 | (EP) | B41J 2/175 |
| 0645243 | 3/1995 | (EP) | B41J 2/175 |
| 0646465 | 4/1995 | (EP) | B41J 2/175 |
| 6328712 | 11/1994 | (JP) . | |
| WO91/19589 | 12/1991 | (WO) | B23K 20/12 |

OTHER PUBLICATIONS

Tim Carlin, et al., "Development of the HP DeskJet 1200C Print Cartridge Platform," 1266 Hewlett–Packard Journal 45 (1994) Feb., No. 1, Palo Alto, CA, US, pp. 46–54.

Austrian Patent Office, Search Report, pp. 1–3.

*Primary Examiner*—N. Le
*Assistant Examiner*—Michael Nghiem
(74) *Attorney, Agent, or Firm*—Fitzpatrick, Cella, Harper & Scinto

(57) ABSTRACT

An ink-jet ink cartridge having an ink containing portion for containing the ink to be supplied to an ink-jet head, and a lid for covering the ink containing portion, characterized in that a wall of the ink containing portion and one face of the lid are welded together owing to frictional heat by vibration.

37 Claims, 26 Drawing Sheets

INK TANK CARTRIDGE, A MANUFACTURING METHOD THEREOF AND A PACKAGING STRUCTURE OF THE INK TANK CARTRIDGE

BACKGROUND OF THE INVENTION

Field of the Invention

The present invention relates to a replaceable-type ink-jet ink tank cartridge connected to an ink-jet head and storing the ink to be discharged from the ink-jet head, a method for manufacturing said tank, and a package container for the ink tank cartridge.

Also, the present invention relates to an ink-jet ink tank cartridge having a specific internal structure, and a manufacturing method thereof, as well as an ink-jet head using the ink tank cartridge, and a printer (recording apparatus). The present invention is applicable to recording apparatuses, communication equipments, business machines, composite apparatuses, and printers such as e.g., a copying machine or a facsimile apparatus, using an ink-jet technology.

In recent years, ink-jet recording apparatuses have been utilized for a great variety of applications, and there are uses for the output of high duty image of large size and graphics or photo grade, with increasing demands.

On one hand, there is rapidly increasing utilization for smaller or personalized output apparatuses, while having greater output frequency (use frequency), resulting in more and more increasing print volumes in those applications.

In any way, in the ink-jet print field, there is a tendency toward the larger size, higher duty, and higher use frequency, and due to increased ink consumption, there is increasing demand for the greater capacity of ink tank for the purposes of reducing the frequency of replacing the ink tank cartridge for use in the recording apparatus, and avoiding the damage of head filter. In particular, there is a demand to take not only a simple measure of increasing the size of ink tank cartridge, but also to create a larger capacity of ink tank for the recording apparatus for which the smaller and personalized constitution has been achieved, with the compatibility maintained, for which it has been contemplated that the size of tank cartridge is increased and the shape of tank is altered.

Herein, one form of the ink tank cartridge to increase the ink amount has been proposed in which a first storage chamber for containing the ink, and a second storage chamber for containing the ink, are formed, with a negative pressure generating member such as a sponge provided within the first storage chamber.

The first storage chamber having a negative pressure generating member is provided with an atmosphere communicating opening for communication with the atmosphere, in which an area around the atmosphere communicating opening within this first storage chamber is one where the negative pressure generating member does not hold the ink. Also, this first storage chamber is provided with an ink supply port for supplying the ink held within the negative pressure generating member to an ink-jet head of an ink-jet printing apparatus. The second storage chamber is in communication with the first storage chamber only via a fine communication channel provided at a position apart from the atmosphere communicating opening of the first storage chamber, and stores the ink in a substantially enclosed state. And when using an ink cartridge, the exchange of gas and liquid is made via the fine communication channel between the first and second storage chambers, so that the ink is refilled from the second storage chamber via the fine communication channel into the first storage chamber.

By the way, in the ink-jet printing apparatus, when a plurality of ink-jet heads are mounted on a carriage to reduce the number of line buffer memories, the distance between ink-jet heads is set to be smaller in a scan direction of the carriage in most cases, whereby there are necessarily limitations on the width of ink cartridge when the ink cartridge is mounted on the carriage. Hence, the ink capacity is increased in the height and depth directions of the ink cartridge. Also, to make the foot space of the ink-jet printing apparatus smaller, it is desirable that the ink capacity can be increased only by increasing the height of ink cartridge.

However, in an ink cartridge of the structure of holding the ink soaked within the negative pressure generating member, the water head applied on the ink-jet head is prone to rise in accordance to an increase in height, when the height of ink cartridge is increased, and to prevent this, if the density of negative pressure generating member is raised one-sidedly, the remaining ink amount not used within the ink cartridge increases, making it difficult to expect the effective increase of ink amount corresponding to the increased capacity.

Also, in making such ink tank cartridge of greater capacity, the following affairs may be apprehended.

(1) The air within the second storage chamber will expand due to changes in temperature or pressure when the ink within an ink cartridge is used partially, forcing the ink within the second storage chamber to be flowed into the first storage chamber. Then, it is impossible to expect that the negative pressure is generated by the negative pressure generating member within the first storage chamber, resulting in a positive pressure state. As a result, an adverse effect may be exerted on the formation of meniscus around the ink discharge orifices during the printing or recording or after a suction recovery operation. Herein, by the suction recovery operation is meant an operation of sucking and removing the thickened ink from the ink discharge orifices of ink-jet head.

(2) If the ink capacity is increased, the ink may swell out from the negative pressure generating member of the first storage chamber, mainly due to temperature change (particularly expanded ink volume at low temperatures) during the physical distribution of ink cartridges. Depending on the attitude of ink cartridge in the physical distribution, the ink may not return to the negative pressure generating member, when the temperature rises, accumulating around the atmosphere communicating opening, in which case the ink is more likely to leak and drip when the ink cartridge is unsealed. Also, it is apprehended that when the ink in the positive pressure state is supplied to the ink-jet head, an adverse effect may be exerted on the print performance such as recording.

(3) Even with a slight phenomenon of the above (2), in place of the ink forced from the second storage chamber into the first storage chamber, the air will be moved from the first storage chamber through the fine communication channel into the second storage chamber, by a corresponding amount of ink, whereby when the ink cartridge is unsealed after a rapid increase in temperature or a decrease in pressure, the ink forced from the second storage chamber into the first storage chamber due to expanded air can not be accepted by the negative pressure generating member, with a risk that the ink may exude outside via the atmosphere communicating opening. Also, when unsealing an ink supply port, a portion around the ink supply port within the first storage chamber is in positive pressure state, with a risk that the ink may also leak out of the ink supply port.

Also, if the ink tank cartridge is constructed in larger size (scale up), the negative pressure generating member is also increased in size, resulting in a greater distance from the ink storage chamber to the ink supply port. That is, the larger ink tank will have a greater distance from the communication channel to the supply port, and further be subjected to the influence from the uneven density accompanied by the larger size of the negative pressure generating member accommodated within the negative pressure generating member receiving portion, with a risk that the ink level is not stable, leading to an ink supply failure in worst cases.

Also, an non-ink region within the negative pressure generating member not containing the ink is intended to prevent the ink from leaking through the atmosphere communicating opening, when starting to use the ink tank, but this non-ink region occupies a large area with increasing size of the cartridge, thereby with a risk that the same problem of ink supply failure as above may occur. Namely, in this way, if the ink cartridge is subject to the influence of changes in environment due to storage or physical distribution in the state where the non-ink region is large, the ink is moved to the non-ink region within the negative pressure generating member, resulting in a likelihood that an ink absent portion may arise in a range from the communication channel to the supply port.

On the contrary, it is considered to shorten the distance from the communication channel to the supply port, in which case the initial ink level within the negative pressure generating member is too high compared with the total volume of negative pressure generating member, and to retain this initial ink level, it is necessary to significantly raise the capillary force of negative pressure generating member, with the result that the negative pressure on the recording head is too great, inappropriately for the fast recording. Also, the large amount of ink may remain.

The ink-jet ink cartridge having larger size and more complicated shape as above described must satisfy the ink-jet performance at the same time. That is, the ink-jet ink cartridge is required to have the sealing ability without ink leakage which is assured for use in the high/low temperature environment or the long-term storage, and various external factors including a mechanical strength against thermal shock caused by repeated high/low temperatures, vibration, or drop, as well as quite severe characteristics of stably storing the ink and without damaging the ink supply capability in use for recording or the negative pressure exerted on the recording head, as previously described.

For such requirements, a method of forming an ink container is known in which two members, a container having integrally molded a partition plate for partitioning the negative pressure generating member receiving portion and the ink containing portion, and a lid, are integrated by fusing a joint by heat or ultrasonic.

However, a heat welding method could not be applied to the ink cartridge of such a complex shape that the joint extends into the tank, because the joint must be exposed to the outside for welding. Accordingly, the container of integral mold was molded in the configuration having the partition plate and the wall within the container connected. Also, a ultrasonic welding method in which ultrasonic is applied to the joint to weld by heat generated by thermal conversion of acoustic wave due to energy loss at the joint is difficult to make a perfect contact state over the entire area of welding portion due to the dimensions of parts if the size is increased, because the contact state at the joint has a dimensionally severe factor.

On the other hand, in the conventional ink tank as previously described, one package in which a seal member of the atmosphere communicating opening and the ink supply port of the ink tank is adhered to a pillow bag in packaged form was proposed in Japanese Laid-Open Patent Application No. 6-328712. In this packaged form, the ink, if splashing due to a peeling force from the seal member peeled off in unsealing the package, is received into the bag, while the package is unsealed in the order from the atmosphere communication opening, without the user considering the unsealing order of the atmosphere communicating opening and the ink supply port.

In the conventional form, when the ink capacity of ink tank is relatively small, the internal pressure of ink tank may rise, owing to changes in environment (pressure, temperature) surrounding the ink tank at the time of manufacturing or unsealing. Then, if the ink tank is unsealed, the ink may be forced out of the ink tank. This ink amount will vary with the total capacity of ink for the ink tank. It increases with larger capacity of ink tank. Since the ink tank is desired to have larger capacity, the amount of splashing ink may be serious in the conventional packaged form, if the larger capacity is provided, so that there are some cases that the ink can not be held within the pillow bag.

Also, with the larger amount, the ink may enter, due to capillary phenomenon, into an interstice between the ink tank and the pillow bag, resulting in greater probability that the ink reaches the hands of the user who holds by hand the ink tank.

Further, in the form of pillow bag, the user may neglect the way of unsealing, break the bag open and peel off a scal member for sealing the atmosphere communicating opening and the ink supply port of ink tank.

In this case, in peeling off the seal member, the ink may splash from the seal member upon an impact of peeling in some instances.

SUMMARY OF THE INVENTION

The present invention has been achieved in the light of the aforementioned problems, and its object is to provide an ink cartridge and a method of determining the volume of said ink cartridge, in which ink leakage through an atmosphere communication opening caused by changes in environment is prevented even when the volume of an ink containing chamber is increased.

The present invention has been achieved to solve the above-mentioned problems, and its object is to provide an ink cartridge which can realize the larger size and greater capacity of the ink cartridge, without degrading the performance or reliability as the ink cartridge.

It is a further object of the invention to provide an ink cartridge which can realize the larger size and more complex shape of the ink cartridge with the minimum number of components by a quite simple manufacturing method, while satisfying the required performance for the large ink-jet ink cartridge, and the manufacturing method thereof.

It is another object of the invention to provide an ink cartridge and an ink-jet cartridge, which is capable of maintaining the stable print performance at any time by stably supplying the ink, without being affected by the ink exuding from a negative pressure generating member, while preventing the ink from leaking in unsealing an ink containing portion.

A preferred constitution of the present invention includes at least one of the following constitutions, or any combination thereof.

First of all, a method of weakening the vibration vector in a wall collapsing direction by providing the wall at an angle toward a direction of applying the transverse vibration and opposite a direction of causing collapse of the tank wall in the state where the tank wall is thinned is taken.

Secondly, a method of having at least two sorts of vibration directions to prevent the collapse of wall resulting from transverse vibration is taken.

Thirdly, reinforcing means is provided against transverse vibration on the collapsing side of wall.

Fourthly, clamp means for clamping the wall to a jig for fixing a container is provided.

Fifthly, securing means for securing the wall by inserting a wall collapse preventing jig through an opening portion such as an ink inlet port into the tank or a supply port for supplying the ink to the head is provided.

Sixthly, a method is taken in which the negative pressure generating member is made of the same material as the container or lid of the tank, or a material having the same melting point, or a higher melting point than that of the latter, allowing melting and welding completely, even if the negative pressure generating member is pinched into a joint between the container and the lid, thereby preventing leakage.

Seventhly, a method of determining the vibration direction when stopped so that the negative pressure generating member and the tank wall face are brought into close or pressure contact with each other in a preferred state, when the transverse vibration is stopped.

Eighthly, the negative pressure generating member is secured to a member on the side where it vibrates, subject to transverse vibration, to further enhance the effect of the seventh method, while at least two or more securing means are provided to prevent the compression distribution of the negative pressure generating member from being disordered, even if the negative pressure generating member is subject to rotational force.

Ninthly, vibration suppressing means is provided on members at both sides of applying the vibration and accepting the vibration to prevent the member which vibrates subject to transverse vibration from yielding the amplitude, more than necessary.

Tenthly, a vibration jig of the device generating transverse vibration and a member accepting vibration from this vibration jig and vibrating along with it are provided with slip preventing means for preventing slip vibration transmission rate from being degraded.

Eleventhly, a plurality of welding parts which are completely independent and closed are provided, the welding parts being complicated such that an area inside the tank is divided into a plurality of sections, allowing the sealing ability at the welding portion to be examined, while preventing unnecessary movement of ink between each area.

Twelfthly, suppressing means for suppressing burrs produced at the welding part is provided, while a leakage preventing member can be flowed into that welding part. Also, ink infiltration preventing means for preventing ink from infiltrating into burrs outside the welding part is provided.

Thirteenthly, the formation of an opening portion of tank by welding multiple members together can be stably made.

It is another object of the present invention to provide an ink-jet ink cartridge having an ink containing portion for containing the ink to be supplied to an ink-jet head, and a lid portion for covering said ink containing portion, wherein a wall of said ink containing portion and one face of said lid portion are welded together by frictional heat caused by vibration.

Also, it is a further object of the present invention to provide an ink-jet ink cartridge in communication with said ink containing portion via a communication channel, and further comprising a negative pressure generating member receiving portion for receiving an negative pressure generating member for absorbing and holding the ink, an ink-jet ink cartridge wherein the angle θ made by the longitudinal direction of the wall of said ink containing portion main body to the vibration direction is less than 90°, an ink-jet ink cartridge wherein the angle θ made by the longitudinal direction of each wall of said ink containing portion and said negative pressure generating member receiving portion to the vibration direction is less than 90°, an ink-jet ink cartridge wherein said angle θ is less than or equal to 45°, an ink-jet ink cartridge wherein said vibration direction is multidirectional, an ink-jet ink cartridge wherein said wall is provided with means for preventing collapse of said wall against said vibration, an ink-jet ink cartridge wherein the angle θ made by the longitudinal direction of said wall to said vibration direction is less than or equal to 90°, and said wall is provided with wall collapse preventing means for preventing collapse of said wall against said vibration, an ink-jet ink cartridge wherein said wall collapse preventing means is means for fixing to a fixed jig provided on the wall outside said ink containing portion or said negative pressure generating member receiving portion, an ink-jet ink cartridge wherein said wall collapse preventing means relies on a jig inserted through an opening portion of said ink containing portion, an ink-jet ink cartridge wherein at least the wall of said ink containing portion with frictional heat produced by said vibration among said ink containing portion and one face of said lid are made of the same material, an ink-jet ink cartridge wherein the melting point of a material forming at least the wall of said ink containing portion with frictional heat produced by said vibration among said ink containing portion and that of a material forming one face of said lid are equal, an ink-jet ink cartridge wherein the melting point of the material forming at least the wall of said ink containing portion with frictional heat produced by said vibration among said ink containing portion and that of the material forming one face of said lid are higher than that of a material forming the other section of said ink containing portion, an ink-jet ink cartridge wherein said ink containing portion has means for suppressing the amplitude of said vibration, an ink-jet ink cartridge wherein said amplitude suppressing means comprises engagement means provided on said ink containing portion, and engaged means provided on said lid and being engaged by said engagement means, an ink-jet ink cartridge further comprising means for screening outer welding burrs produced due to said vibration in welding, an ink-jet ink cartridge having at least one member for securing said negative pressure generating member to said negative pressure generating member receiving portion, a manufacturing method of an ink-jet ink cartridge having an ink containing portion for containing the ink to be supplied to an ink-jet head and composed of an ink containing portion main body and a lid, wherein after said ink containing portion main body and said lid are superposed on one another, the ink containing portion main body and the lid are welded together with frictional heat produced at a contact region by applying vibration to said ink containing portion main body and said lid, a manufacturing method of an ink-jet ink cartridge using a vibration jig which applies vibration to said ink containing portion main body and said lid, and means for preventing occurrence of slip between said ink containing portion main body and said lid, a manufacturing method of an ink-jet ink cartridge wherein said slip preventing means utilizes vacuum adsorption, a manufacturing method of an ink-jet ink cartridge wherein a sealant or an adhesive is infiltrated into outer welding burrs produced due to said vibration in welding, a manufacturing method of an ink-jet ink cartridge comprising an ink containing portion for containing the ink to be supplied to an ink-jet head, a negative pressure generating member receiving portion in communication with said ink containing portion via a communication channel and receiving a negative pressure generating member for absorbing and holding the ink, and a lid for covering said negative pressure generating member receiving portion and said ink receiving portion, characterized in that after said ink containing portion and said negative pressure generating member receiving portion and said lid are superposed on one another, said ink containing portion and said negative pressure generating member receiving portion and said lid are welded together with frictional head produced at a contact region by applying vibration to said ink containing portion and said negative pressure generating member receiving portion and said lid, a manufacturing method of an ink-jet ink cartridge wherein said vibration is stopped in a vibration direction of enclosing said communication channel with said negative pressure generating member with said negative pressure generating member placed into close contact with a wall of said ink containing portion, a manufacturing method of an ink-jet ink cartridge wherein a welding line formed by said vibration has no branch, a manufacturing method of an ink-jet ink cartridge wherein the welding line formed by said vibration is formed independently between said ink containing portion and said negative pressure generating member receiving portion, or a head cartridge comprising the above-mentioned ink cartridge, and an ink-jet head for recording by being supplied with the ink from said cartridge.

With the above constitution and method, the welding of a lid for the side wall corresponding to large and complicated shape which was conventionally not achievable with the type of welding the lower lid limited to small and simple shape can be made.

It is another object of the present invention to provide an ink cartridge comprising a negative pressure generating member receiving portion for receiving a negative pressure generating member, and an ink containing portion, provided separately from said negative pressure generating member receiving portion, for directly storing the ink, wherein the gas introducible via an atmosphere communication opening provided on the side of said negative pressure generating member receiving portion, and the ink of said ink containing portion, are exchanged by gas-liquid exchanging means, to conduct said ink to the negative pressure generating member receiving portion, and supply the ink from said negative pressure generating member receiving portion, characterized by further comprising a space formed between said negative pressure generating member receiving portion and said atmosphere communicating opening, composed of a subspace containing a member in direct contact with said negative pressure generating member, and other subspace.

Also, it is another object of the present invention to provide an ink tank cartridge wherein said space of said ink cartridge has a volume determined by at least the following expression:

(Volume of space)=(Total volume of ink storable within said ink containing portion)×(Value determined based on the variation in external pressure relative to pressure within said ink containing portion of said ink cartridge)−(Volume of said negative pressure generating member)×(Value determined based on the ink absorptivity of said negative pressure generating member).

Also, it is another object of the present invention to provide a method for determining the volume of an ink cartridge comprising a negative pressure generating member receiving portion for receiving a negative pressure generating member, and an ink containing portion, provided separately from said negative pressure generating member receiving portion, for directly storing the ink, wherein the gas introducible via an atmosphere communication opening provided on the side of said negative pressure generating member receiving portion, and the ink of said ink containing portion, are exchanged by gas-liquid exchanging means, to conduct said ink to the negative pressure generating member receiving portion, and supply the ink from said negative pressure generating member receiving portion, characterized in that the volume of a space between said negative pressure generating member receiving portion and said atmosphere communication opening is determined according to the following expression:

(Volume of space)=(Total volume of ink storable within said ink containing portion)×(Value determined based on the variation in external pressure relative to pressure within said ink containing portion of said ink cartridge)−(Volume of said negative pressure generating member)×(Value determined based on the ink absorptivity of said negative pressure generating member).

With the above constitution, a space having a predetermined volume or greater is formed between said negative pressure generating member and said atmosphere communication opening, wherein since the volume of this space is determined in view of the relative external pressure change of the ink cartridge, the ink can be prevented from leaking through said atmosphere communication opening, even if the ink exudes from the negative pressure generating member due to this change.

It is another object of the present invention to provide an ink tank package container comprising a first receiver for receiving an ink tank having an atmosphere communication opening and an ink supply port which are sealed by a seal member, and a second receiver for receiving said first receiver, wherein a part of said seal member is exposed through an opening portion of said second receiver, and said atmosphere communication opening and said ink supply port are unsealed by pulling out said exposed part of seal member.

Also, it is another object of the invention to provide, an ink tank package container wherein said first receiver is an inner box, and said second receiver is an outer box, an ink tank package container wherein said seal member for sealing said atmosphere communication opening and said seal member for sealing said ink supply port are integral, and wherein a part of said seal member integral is exposed from an opening portion of said outer box, said ink supply port being unsealed, following said atmosphere communication opening, by pulling out a part of said exposed seal member, an ink tank package container wherein a part of said seal member is bonded to an outer face near the opening portion of said outer box, an ink tank package container wherein a part of said seal member is bonded to an outer face near the opening portion of said outer box, the other end of said seal member being exposed from said opening portion of said outer box, an ink tank package container wherein said inner box is slidably received within said outer box, an ink tank package container wherein within said inner box, an ink absorbing member is disposed at a position corresponding to said atmosphere communication opening of said ink tank received within said inner box, an ink tank package container wherein within said inner box, an ink absorbing member is disposed at a position corresponding to said ink supply port of said ink tank received within said inner box, an ink tank package container wherein within said inner box, ink absorbing members are disposed at respective positions corresponding to said atmosphere communication opening and said ink supply port of said ink tank received within said inner box, an ink tank package container wherein an ink absorbing member is disposed on a bottom portion within said inner box, an ink tank package container receiving said ink tank where said ink absorbing member has a dot- or mesh-like face, and is in contact with said in tank via said face, an ink tank package container wherein an ink supply port is covered with a member spaced apart in a direction of peeling off the seal member covering said ink supply port of said ink tank, an ink tank package container wherein the seal member covering said ink supply port of said ink tank can be pulled out with one of its faces contact with the inner wall of said ink tank pressed against a part of said inner box, an ink tank package container wherein said pullable seal member can be pulled out, while being carried between said inner box and said outer box, an ink tank package container wherein a part of said seal member bonded to said ink tank is bonded to an outer face of said outer box, the other part of said seal member projecting out of said outer box, an ink tank package container wherein a face of said seal member bonded to the outer face of said outer box and a face of said seal member covering said ink supply port of said ink tank are situated on the same side, an ink tank package container wherein a part of said seal member and a part of said outer box are bonded together, so that said seal member and a sealed portion of said ink supply port may be subject to a force other than in a direction of peeling off said seal member, when said inner box is drawn out of said outer box, an ink tank package container wherein said seal member is a folded lengthwise member, the both ends thereof projecting out of an opening of said outer box, one end thereof being bonded to the outer face of said outer box, wherein a face on the same side as said bonded face covers said ink supply port, an ink tank package container wherein a thrust direction of a welding part of said seal member welded to said ink supply port and a direction of peeling off said seal member from said ink supply port are orthogonal, or an ink tank package container wherein said outer box is laminated with a resin film.

The present invention uses a member for packaging an ink tank which is a box, said box for accommodating said partial ink tank having ink absorbing members disposed at positions corresponding to an ink supply port and an atmosphere communication opening, and an ink absorbing member laid between said ink tank and said box accommodating said ink tank, whereby even if the ink flows out of said ink tank in unsealing, the ink can be absorbed into said three absorbing members. Thereby, the user is protected from staining the hands in use without the ink flowing outside a packaging material.

In the present invention, a member for packaging an ink tank is in the form of a box. The box is twofold, such that the ink tank can not be taken out, unless the ink supply port and the atmosphere communication opening are unsealed. Specifically, the ink tank is secured to an inner box of the ink tank. The box is slidable to left and right, rather than upward and downward, to enable the inner box to be drawn out. To limit the drawing direction, a lid is provided on an outer box at one side in the drawing direction, wherein the atmosphere communication opening and the ink supply port are sealed with a seal member. The seal member is welded to the ink tank, an unfolded end portion being bonded to a face of the outer box so that the drawing direction of the box may be a direction of pulling the box. Further, the other end of the seal member is pulled out through a hole provided on a face of the outer box where said seal member is bonded. In this package form, a considerable force may be required to draw out the inner box from the outer box, unless unsealed by first pulling the seal of the ink tank, so that the ink tank can not be taken out without peeling off the seal of the ink tank in practice. Also, the order of unsealing is that the atmosphere communication opening is first unsealed, or the user is instructed. Further, the outer box may be laminated not to be easily broken to higher effect, rather than a typical paper box.

In the above, further adopting a packaging form in which when the seal member is peeled off, the ink supply port of the ink tank provides an obstacle in the direction of peeling off the seal member, and a part of the seal member which has been in contact with the inside of the ink tank is pressed against a part of the packaging box, after the seal is peeled off, the ink is prevented from splashing outside the packaging box through the ink supply port of ink tank by being pulled by the seal member, upon unsealing the ink tank. Also, the seal member has an ink adhering portion wiped out by a part of the packaging box (pressed portion), thereby preventing the ink from spoiling the outside.

BRIEF DESCRIPTION OF THE DRAWINGS

FIGS. 18A and 18B are views for explaining wall collapse reventing means at the time of vibration welding, respectively, wherein FIG. 18A is a cross-sectional view showing an instance of preventing wall collapse by inserting a jig through an opening portion of the ink cartridge, and FIG. 18B is a cross-sectional view taken along the line 18B—18B in FIG. 18A.

FIGS. 27A and 27B are views showing an ink cartridge to which a manufacturing method of an ink cartridge of the present invention is applicable, wherein FIG. 27A is a cross-sectional view and FIG. 27B is an exploded perspective view.

DETAILED DESCRIPTION OF THE PREFERRED EMBODIMENTS

The embodiments of the present invention will be described below in detail with reference to the drawings.

Figure 1A:
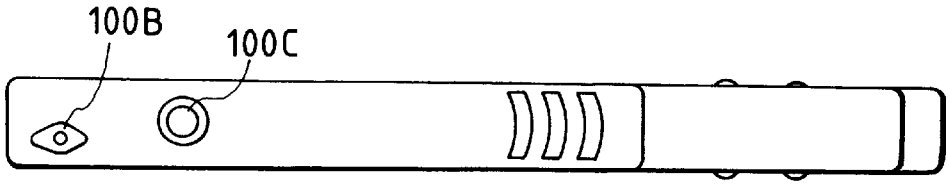
FIGS. 1A, 1B and 1C are an upper view, a side view and a bottom view of an ink cartridge according to one embodiment of the present invention.
Figure 1B:
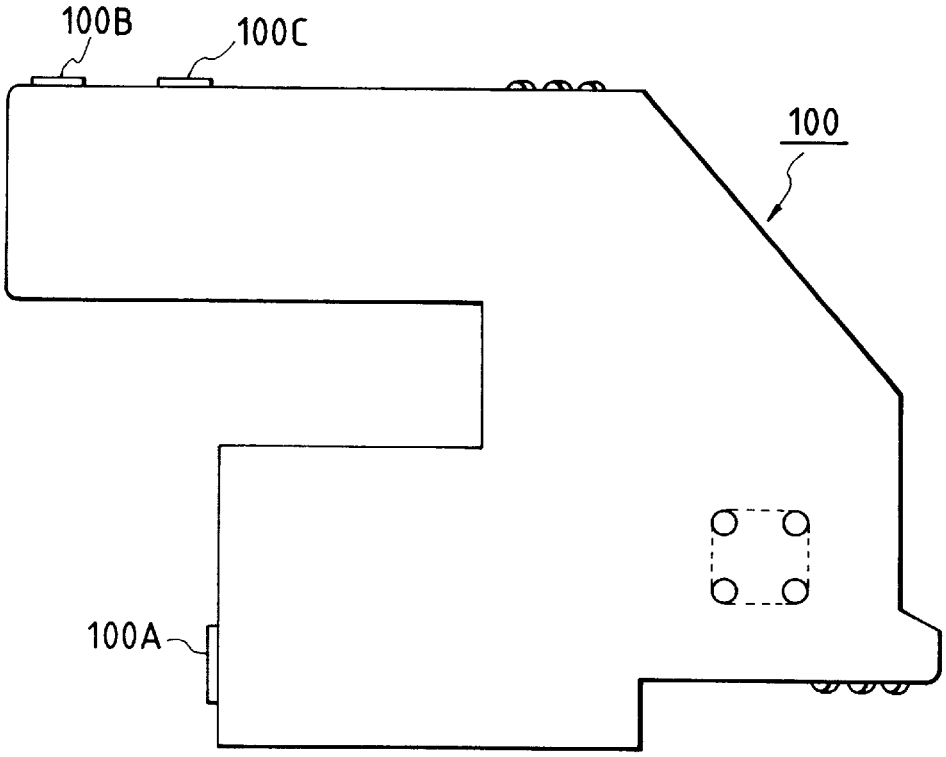
Figure 1C:
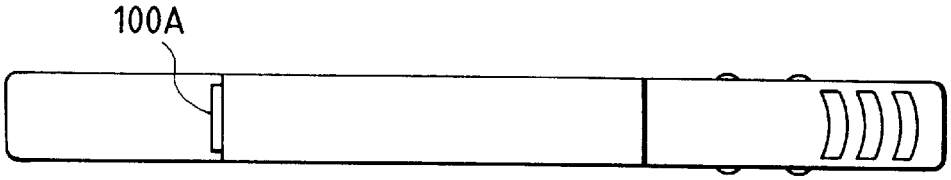
Figure 2:
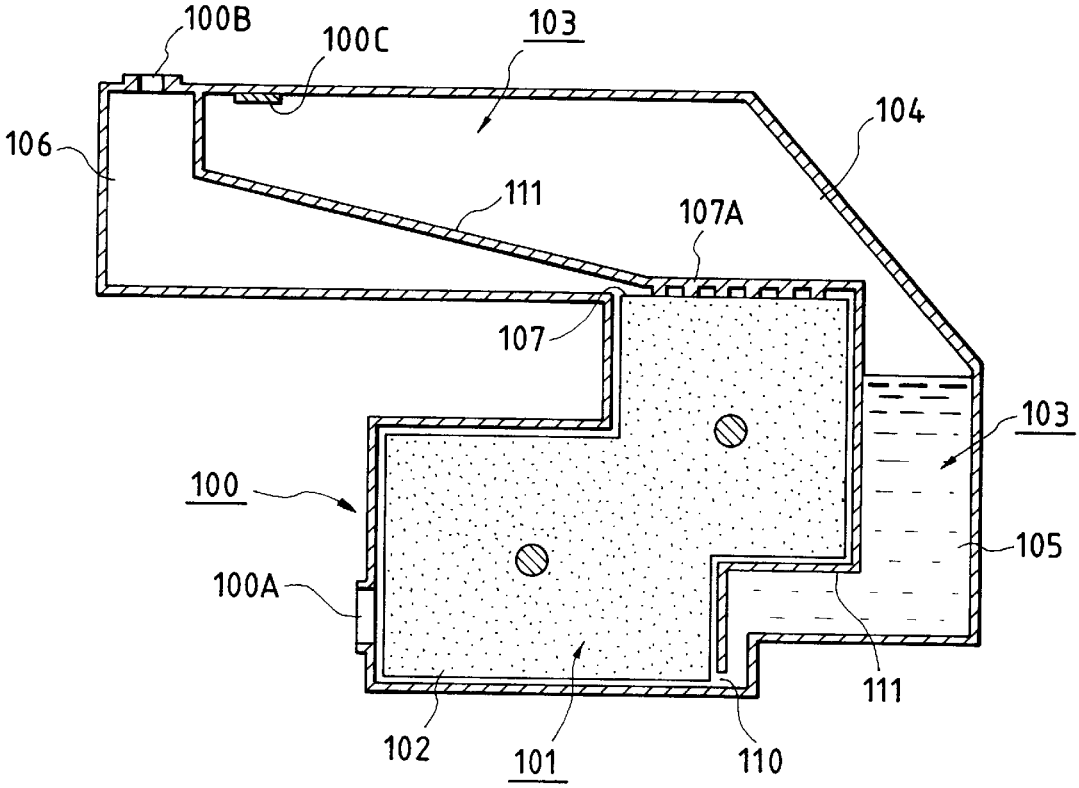
FIG. 2 is a cross-sectional view typically showing the inside of the ink cartridge.

FIGS. 1A to 1C are three side views showing the appearance of an ink cartridge according to one embodiment of the present invention, and FIG. 2 is a cross-sectional view typically showing its inside.

As shown in FIGS. 1A to 2, the ink cartridge 100 of this embodiment presents an appearance almost like a U-shaped character, with a constant width. Provided at one end of the U-shaped character shape on the bottom is an ink supply port 100A, which is thereby connected with an ink supply tube of an ink-jet head (not shown) for the supply of the ink. Also, provided above the U-shaped character shape is an atmosphere communication opening 100B, thereby relieving pressure variations within the ink cartridge to maintain its internal pressure substantially constant. An ink inlet port 100C is provided to fill the ink via this ink inlet port when manufacturing the ink cartridge.

As shown in FIG. 2, the ink cartridge of this embodiment is largely divided into two chambers. That is, formed inside this ink cartridge is a partition wall 111 which is substantially at an angle in an upper portion of the cartridge, and runs substantially like a crank in the lower portion, the ink cartridge 100 being divided into two chambers, an ink containing portion 103 and a negative pressure generating receiving portion 101, and spaces 106, 107. A communication channel 110 is provided at the lower end of the partition 111, and a gas and liquid exchanging groove (not shown) is provided on the partition 111 in the vicinity thereof.

The ink containing portion 103 which is one chamber of the ink cartridge 100 is filled with the ink 105 at the initial time of use. Along with the ink consumption the gas (air) is introduced from the negative pressure generating member receiving portion which is the other chamber via the communication channel 110 by the exchange between gas and liquid, as will be described later, so that the air 104 gradually increases in volume.

The negative pressure generating member receiving portion 101 which is the other chamber and the spaces 106, 107 are constituted as follows. The negative pressure generating member receiving portion 101 is densely packed with an ink holding member 102 by conforming with the shape of its receiving portion. This ink holding member 102 is formed of a porous material like sponge to generate an apparent negative pressure relative to atmospheric pressure owing to its capillary force. Provided on the upper portion of the negative pressure generating member receiving portion 101 is a space 107 having a member 107A for regulating the displacement of the ink holding member 102 disposed along the upper portion of the member 102 packed. Further, a space 106 in communication with this space 107 and leading to an atmosphere communication opening 100B is provided. This space 106 has a substantially triangular shape with its volume gradually increasing toward the atmosphere communication opening 100B.

In the ink cartridge with the above constitution, if the ink is consumed by e.g. being discharged by an ink-jet head (not shown), the ink is supplied via the supply port 100A to the ink-jet head, but there may occur a non-uniform pressure distribution within the ink holding member 102. And to make up for this non-uniform pressure distribution, the ink is moved from the ink containing portion 103 via the communication channel 110 to the ink holding member 102. Then, the air 104 within the ink containing portion 103 undergoes a decrease in pressure (an increase in volume) corresponding to the above movement of the ink, but this decrease in pressure can be offset as the air introduced via the atmosphere communication opening 100B into the ink cartridge 100 is finally conducted via the gas and liquid exchanging groove (not shown) of the partition 111 in contact with the ink holding member and the communication channel 110 to the ink containing portion 103.

With the constitution of gas and liquid exchange as above described, if the ink within the ink containing portion 103 is used up, the ink held by the ink holding member 102 is then gradually consumed.

When the cartridge as above described is mounted on an ink-jet printer, the air 104 within the ink containing portion 103 gradually increases in volume, along with the ink consumption by printing, wherein the air 104 is retained with the volume at each time. In this state, the air 104 relatively increases in pressure and expands, owing to variations in printer environment, for example, a pressure change when printer is transported from the plain to a higher place. Thereby, the ink 105 within the ink containing portion 103 is compulsorily moved to the negative pressure generating member receiving portion 101, thereby to cause overflow of the ink which can not be held by the ink holding member 102 to the spaces 106, 107.

In this embodiment, the volume of spaces 106, 107 in the ink cartridge can be determined by defining the amount of overflow ink in the following way. Note that each of the spaces 106 and 107 is hereinafter referred to as a buffer portion.

A way of determining the volume of buffer portion in the ink cartridge as above described to which the present invention is applied will be described below.

As above described, the air 104 within the ink containing portion 103 increases in volume, along with the consumption of the ink 105 within the ink containing portion 103. Accordingly, the volume I of the ink 105 within the ink containing portion 3 can be represented by the following expression, assuming that the total volume (maximum ink volume) of the ink containing portion 3 is $I_{max}$ and the volume of the air 104 is A:

$$I=I_{max}-A \tag{108}$$

Then, the air 104 within the ink containing portion 3 expands owing to a change in external pressure (P→P') of the ink cartridge, for example, the volume M of ink moved compulsorily from the ink containing portion 103 into the negative pressure generating member receiving portion 101, which is caused by its changed volume from A to A', is equal to the value of A' minus A, and thus can be represented by the following expression:

$$M=A'-A$$

Herein, if the pressure of the air 104 is changed from $P_i$ to $P_i'$, owing to expansion of the air 104 as above described, an expression $A'/A=P_i/P_i'\equiv\alpha>1$ stands from a state equation of the air before and after this change. And this a can be said to be a function of external pressure change (from P to P').

From the above, the ink moving volume M can be represented by the following expression:

$$M=A'=A=\alpha A-A=(\alpha-1)A \tag{109}$$

Figure 3:
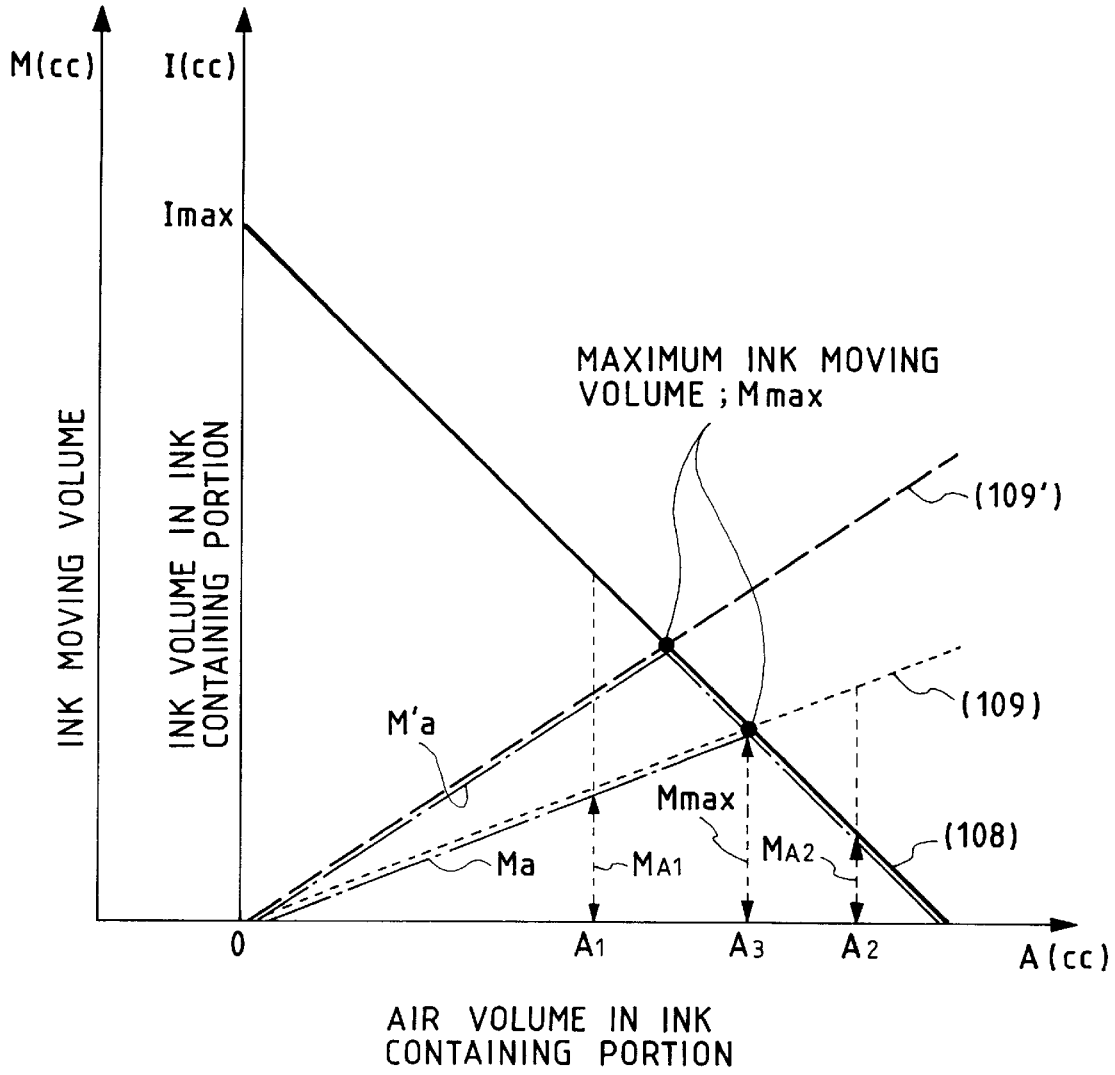
FIG. 3 is a graph for explaining how to obtain the maximum volume of ink movement from an ink containing portion in the ink cartridge.

FIG. 3 is a graph representing the relation between the above expressions (108) and (109). Note that in the same figure, (109') represents the moving volume M' when $\alpha$ corresponds to other external pressure.

In FIG. 3, considering the ink moving volume M, when the volume A of the air 104 is smaller than $A_3$, e.g., equal to $A_1$, the ink moving volume is equal to $M_{A1}$, according to the expression (109), while when it is greater than $A_3$, e.g., equal to $A_2$, the practical ink moving volume is equal to $M_{A2}$, because the practical volume of ink accords to the expression (108).

From the above, the practical ink moving volume is equal to $M_a$ as indicated by the dot-dash line in the same figure, the maximum value is reached when the volume of the air 104 is $A_3$, i.e., the value of intersecting point $M_a$ between a line 108 and a line 109 is equal to the maximum ink moving volume $M_{max}$. Accordingly, from the expressions (108) and (109), an expression for the maximum ink moving volume:

$$M_{max}=(\alpha-1)(I_{max}-I) \quad (110)$$

can be obtained for the ink volume I.

Herein, in the above expression (110), the maximum value ($M_{max}$) when the ink volume is changed can be represented by the following expression under the restriction that the maximum ink moving volume $M_{max}$ can not exceed the actually existing ink volume:

$$(M_{max})_{max}=(\alpha-1)/\alpha\cdot I_{max}=(P_i-P_i')/P_i\cdot I_{max}\cdot\Delta P/P_i\cdot I_{max} \quad (111)$$

Herein, $\Delta P=P_i-P_i'$ can be said to be a function of external pressure change (P−P'), and accordingly, the above expression (111) can be construed as (Maximum ink moving volume)=(Value obtained from external pressure change)× (Total volume of ink containing portion).

Herein, supposing that the severest condition which may occur in the printer environment is set experimentally, $\alpha$ is obtained under that condition, and based on that, the maximum ink moving volume is obtained under that condition, according to the expression (111), the estimated external pressure change is expressed as P'=1 to 0.6 atm, when an ink cartridge mounted on the printer in the plain at P=1 atm ($1.01325\times10^5$ Pa) is transported to the higher place, for example. Accordingly, it suffices to suppose that the severest condition is a change to P'=0.7 atm in this case.

Then, the ink with the maximum ink moving volume obtained as above is moved to the ink holding member 102, and partly absorbed and held by the ink holding member, in an amount of 5% to 20% of the total volume of the ink holding member. When a porous member making up the holding member is compressed one-fourth, and packed into the cartridge, the above percentage is 10% to 15%. In view of holding the ink in the ink holding member, the maximum volume of ink overflowing to the buffer portions 106, 107 is equal to:

Maximum overflow ink volume=(Total volume of ink containing portion)×(Value obtained from external pressure change)−(Volume of ink held by the ink holding member)

Herein, the volume of ink held within the ink holding member is equal to:

Total volume of negative pressure generating member receiving portion (Total volume of ink holding member)×T where T is from 0.05 to 0.2, as above described. It is preferable that the value of T in this embodiment is a median in the range from 0.1 to 0.15, when the porous member is compressed one-fourth.

Since the maximum ink moving value can be defined under the pressure as above supposed, the minimum volume of buffer portion as required can be defined and ink leakage through the atmosphere communication opening can be thereby prevented. As a result, in spite of the increased ink volume of the ink cartridge for ink-jet printing, an easy-to-use ink cartridge can be obtained, with the minimum increase of cartridge size as required, and without causing ink leakage. Also, if the volume of buffer portion as above can be secured, the degree of freedom in designing the cartridge will be increased, because the shape itself does not matter as a rule.

As above described, according to the present invention, a space having a predetermined volume or greater is formed between the negative pressure generating member and the atmosphere communication opening. And since the volume of this space is determined in consideration of relative external pressure change of the ink cartridge, the ink is prevented from leaking through the atmosphere communication opening, even if the ink overflows from the negative pressure generating member due to this change.

Thereby, the minimum volume of buffer portion as required can be defined, and the ink is prevented from leaking through the atmosphere communication opening. As a result, even if the volume of the ink cartridge for ink-jet printer is increased, as easy-to-use ink cartridge can be provided, with the minimum increase in cartridge size and without ink leakage. Also, if the above volume of buffer portion is secured, the degree of freedom in designing the cartridge is raised, as the shape itself does not matter as a rule.

By the way, in the cases where a sufficiently large buffer chamber is provided as previously described, the water head of the absorbing member may not be necessarily placed in desired condition, if the ink enters the buffer chamber due to changes in environment. An effective constitution in such cases will be described below.

Figure 4:
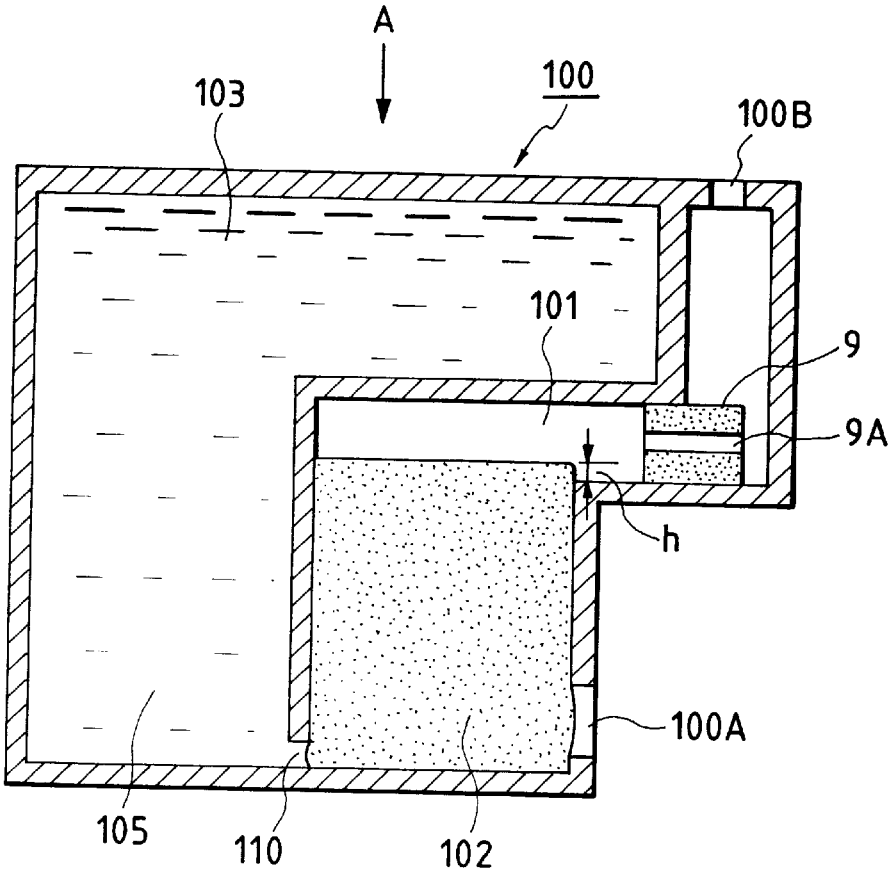
FIG. 4 is a cross-sectional view of an ink cartridge in an example.
Figure 5:
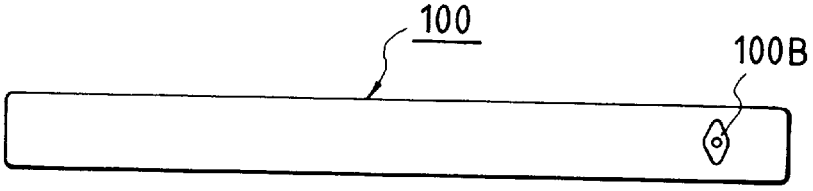
FIG. 5 is a view as looked from the arrow A in FIG. 4.

FIG. 4 is a cross-sectional view typically showing an ink cartridge 100 1, and FIG. 5 is a view as looked from the arrow A in FIG. 4, wherein the ink cartridge 100 is of thin type, as will be seen from FIG. 5. Within a vessel of the ink cartridge 100 are formed a first containing chamber 101 and a second containing chamber 103. On a side wall of the first containing chamber 101 is provided an ink supply port 100A for supplying the ink to an ink-jet head of an ink-jet printing apparatus, not shown, and on an upper wall of the first containing chamber 101 is provided an atmosphere communication opening 100B in communication with the atmosphere. Further, within the first containing chamber 101 are spaced apart a negative pressure generating member 102 and an ink absorbing member 9, which are formed of a porous material such as sponge. The first containing chamber 101 and the second containing chamber 103 are in communication with each other via an ink supply passage 110 as a fine communication channel, the ink being movable between the containing chambers 103, 101 through the ink supply passage 110. The second containing chamber 103 is only in communication with the first containing chamber 101 via the ink supply passage 110, the second containing chamber 103 being substantially in enclosed state.

An ink absorbing member 9 is formed with a through hole 9A, via which the negative pressure generating member 102 and the atmosphere communication opening 100B communicate. Also, the ink absorbing member 9 is secured between the negative pressure generating member 102 and the atmosphere communication opening 100B, but may be movable in the range where its function can be met.

Figure 6:
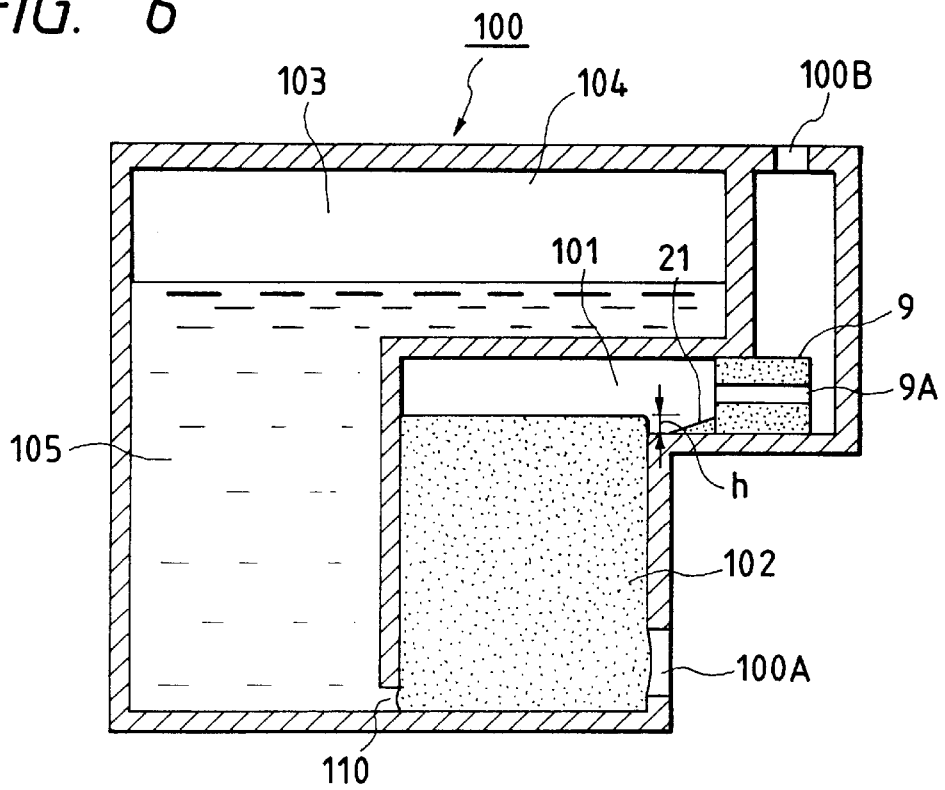
FIG. 6 is a cross-sectional view of the ink cartridge of FIG. 4 in service condition.

FIG. 6 is a cross-sectional view of the ink cartridge 100 in use condition, which is replaceably mounted on the ink-jet printing apparatus, to supply the ink through the ink supply port 100A to the ink-jet head. Within the second containing chamber 103, there exists the air 104 corresponding to the consumed amount of the ink.

The ink cartridge 100 has an increased internal pressure of the air 104 in the second containing chamber 103, due to a decrease in external pressure or rise in temperature, and owing to its increased internal pressure, the ink within the second containing chamber 103 is forced from the ink supply passage 110 into the first containing chamber 101. Then, since the ink supply port 100A is connected to the ink-Jet head having a small nozzle diameter, it follows that the ink will exude from the upper face of the negative pressure generating member 102, before the ink drips from nozzles. In FIG. 6, 21 is the ink which has exuded from the upper face of the negative pressure generating member 102, wherein the ink 21 is absorbed into the ink absorbing member 9. By providing the ink absorbing member 9 having a higher wettability than the negative pressure generating member 102, the exuded ink 21 can be rapidly absorbed into the ink absorbing member 9.

Since the ink 21 absorbed into the ink absorbing member has no effect on the negative pressure of the ink supply port 100A, a proper negative pressure can be always applied by regulating the negative pressure to be used in supplying the ink to the ink-jet head.

Figure 7:
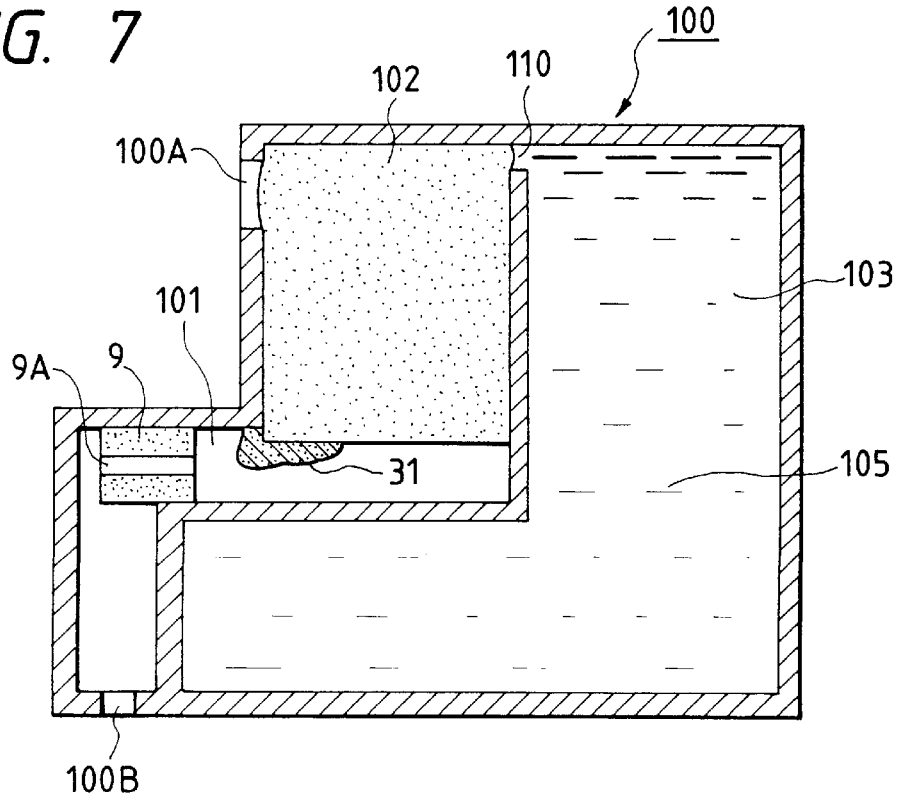
FIG. 7 is a cross-sectional view of the ink cartridge of FIG. 4 placed upside down in low temperature environment.
Figure 8:
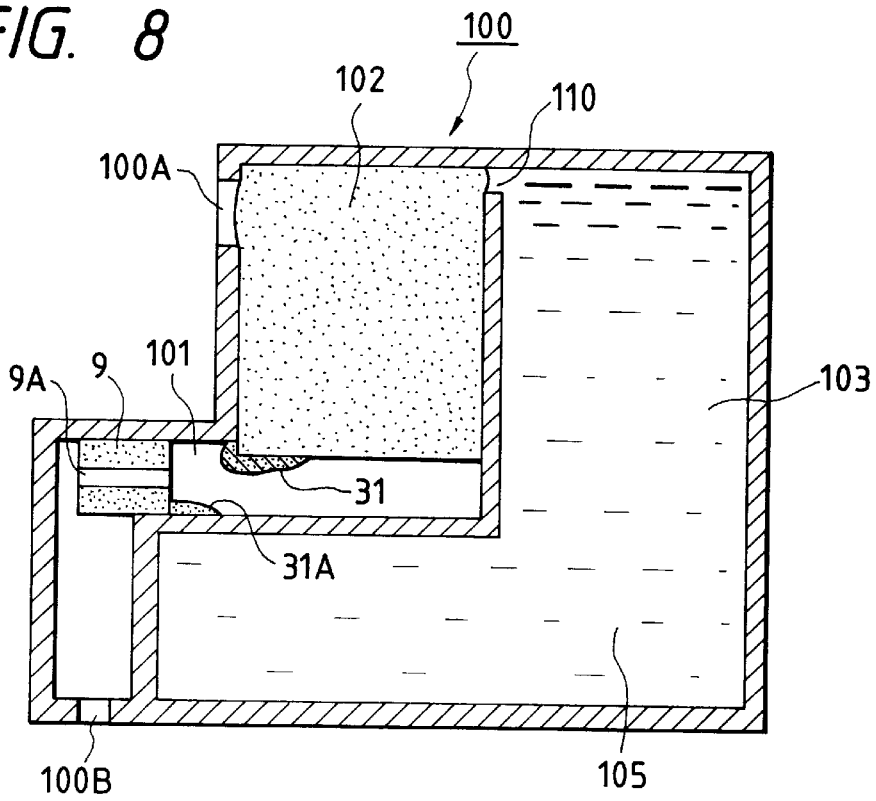
FIG. 8 is a cross-sectional view of the ink cartridge of FIG. 4 placed in high temperature environment.

FIG. 7 is a cross-sectional view of the ink cartridge 100 of this example, which has been subjected to low temperature environment during the physical distribution with the atmosphere communication opening 100B turned downward. In the same figure, 31 is the ink which has been swollen and frozen by expanded volume. When the ink cartridge 100 in a state of FIG. 7 is subjected to high temperature environment, the frozen ink 31 thaws down from the tip end, and the thawed ink 31A is prone to drip down to the atmosphere communication opening 100B, owing to the gravity action as shown in FIG. 8. But the ink 31A is absorbed and captured by the ink absorbing member 9. Accordingly, when the atmosphere communication opening 100B is unsealed in employing the ink cartridge 100, the ink is prevented from dripping out of the atmosphere communication opening 100B.

Figure 9:
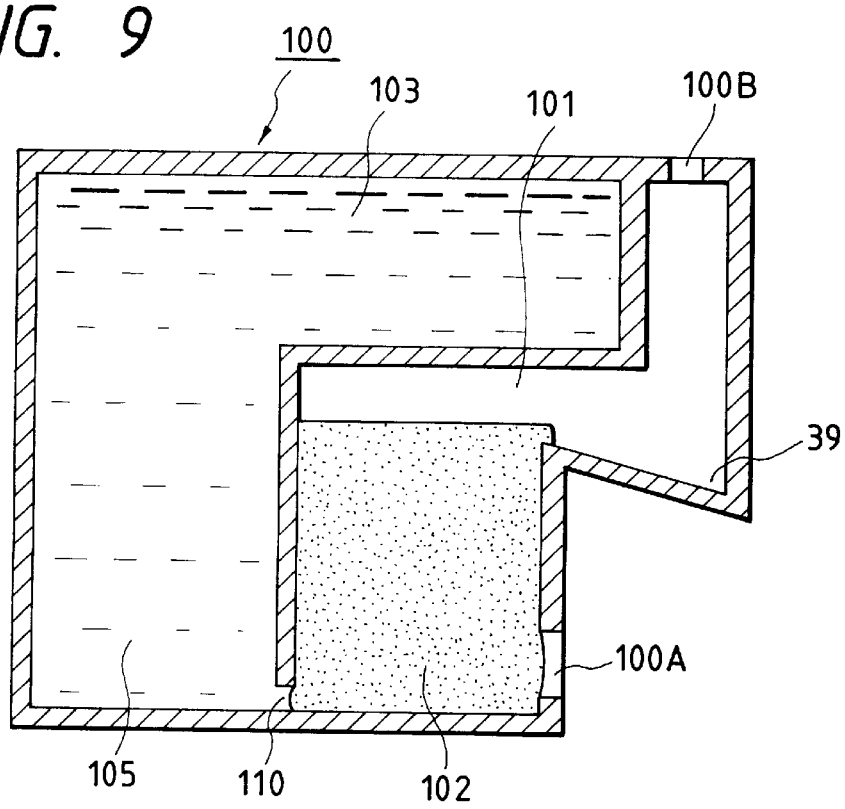
FIG. 9 is a cross-sectional view of an ink cartridge in another example of the present invention.
Figure 10:
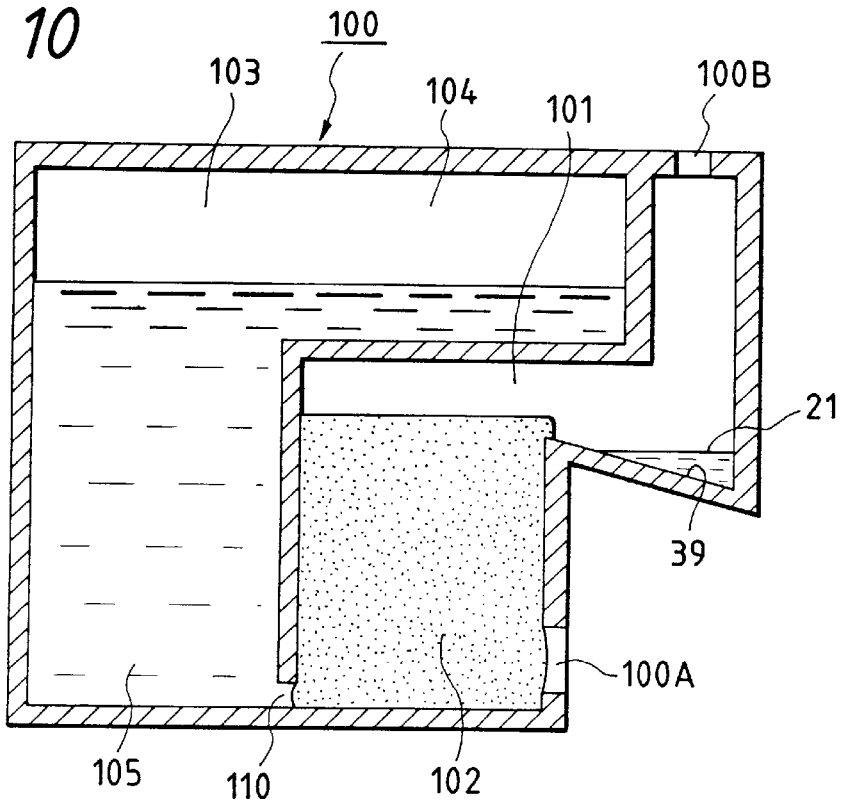
FIG. 10 is a cross-sectional view of the ink cartridge of FIG. 9 in service condition.

FIG. 9 is a cross-sectional view of an ink cartridge 100 in another example, and FIG. 10 is a cross-sectional view of the ink cartridge 100 in use condition.

In this example, the first containing chamber 101 is provided with an ink sink 39 depressed down, in place of the ink absorbing member 9 as in the previous example, the ink sink 39 having the same role as the ink absorbing member 9. Accordingly, this example has a smaller number of parts and is more cost-effective than when the ink absorbing member 9 is provided.

The ink 21 which has exuded from the negative pressure generating member 102 when using the ink cartridge 100 enters the ink sink 39 and accumulates, as shown in FIG. 10. Accordingly, the ink 21 is collected in the ink sink 39 to have no effect on the negative pressure of the ink supply port 100A, and thereby no adverse effect on the discharging of ink droplets from the ink-jet head, as in the previous example. Also, since the ink collected in the sink 39 can be turned back to the negative pressure generating member 102 by removing the ink cartridge 100 from the ink-jet printing apparatus, and tilting it, the ink can be effectively utilized to the last.

Figure 11:
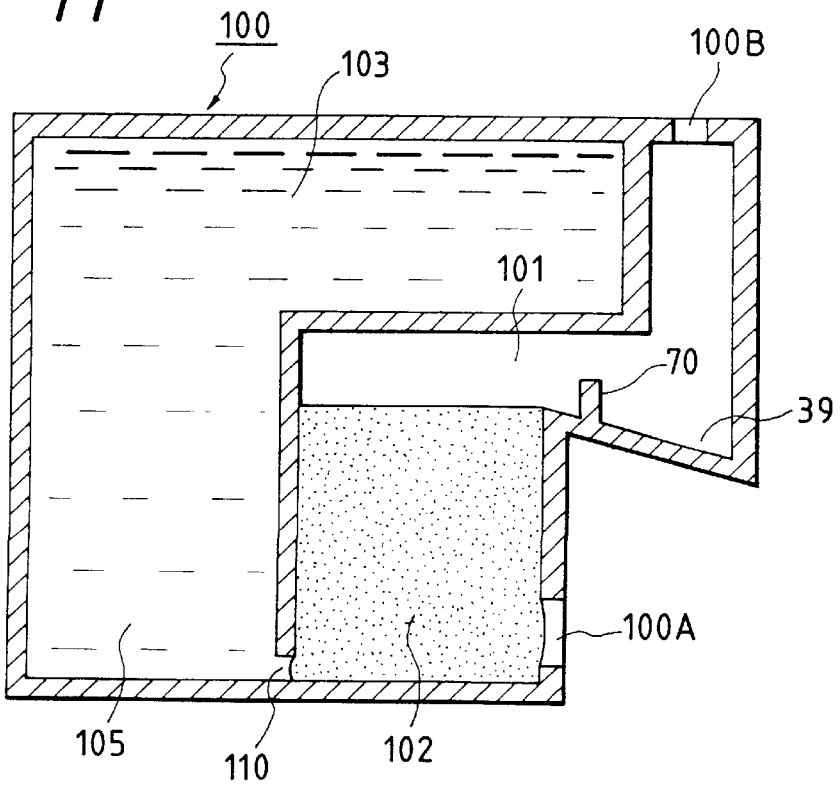
FIG. 11 is a cross-sectional view of an ink cartridge in a further example of the present invention.
Figure 12:
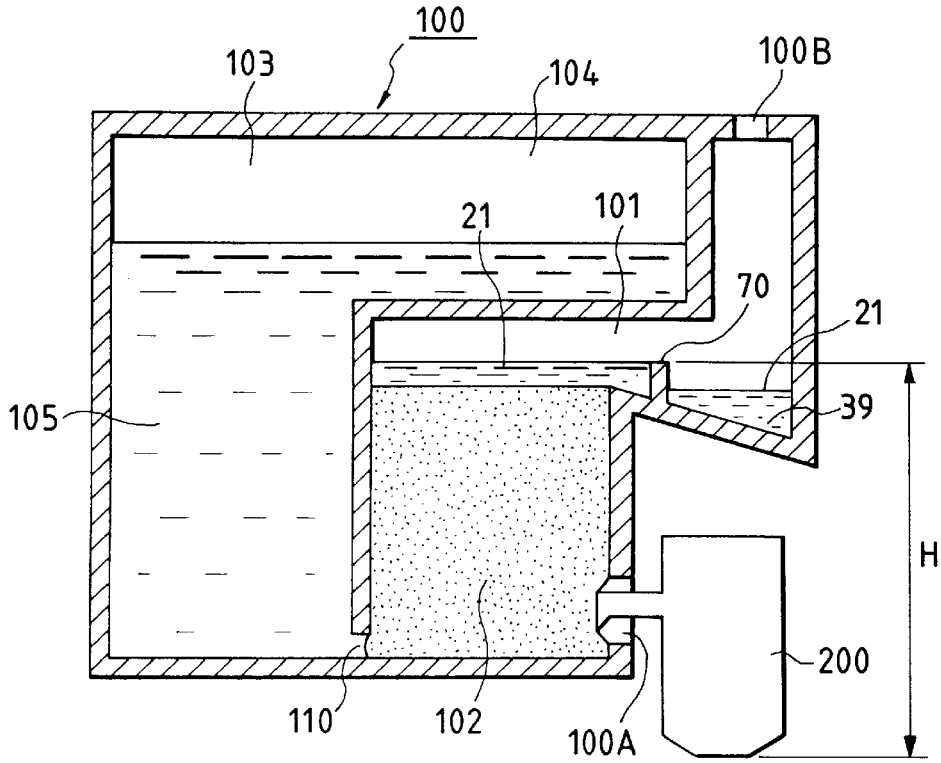
FIG. 12 is a cross-sectional view of the ink cartridge of FIG. 11 in service condition.

FIG. 11 is a cross-sectional view of an ink cartridge 100 in another example, and FIG. 12 is a cross-sectional view of the ink cartridge 100 in use condition.

In this example, a rib 70 is provided between the ink sink 39 and the negative pressure generating member 102, as shown in FIGS. 11 and 12. The ink 21 which has exuded from the negative pressure generating member 102 in using the ink cartridge 100 enters the ink sink 39 over the rib 70 and accumulates, when exuding beyond the height of the rib 70, as shown in FIG. 12.

Accordingly, the ink 21 is not collected over the height of the rib 70 on the negative pressure generating member 102, wherein the maximum collecting amount can be limited by the rib 70. Thus, the ink-jet head can discharge ink droplets stably at any time by determining the positive pressure corresponding to the maximum collecting amount of the ink 21 above the negative pressure generating member 102 in accordance with the height of the rib 70, not to interfere with the printing operation. For example, in the cases where the printing operation does not particularly cause the problem, even if the water head H exerted on the ink-jet head 200 connecting to the ink supply port 100A becomes 60 mm, the height of the rib 70 may be set not to exceed the water head H, as shown in FIG. 12. Accordingly, the rib 70 functions as a limiter for the water head. Also, since the ink 21 collected in the sink 39 can be returned to the negative pressure generating member 102 by removing the ink cartridge 100 from the ink-jet printing apparatus and tilting it, the ink can be effectively utilized to the last.

Figure 13:
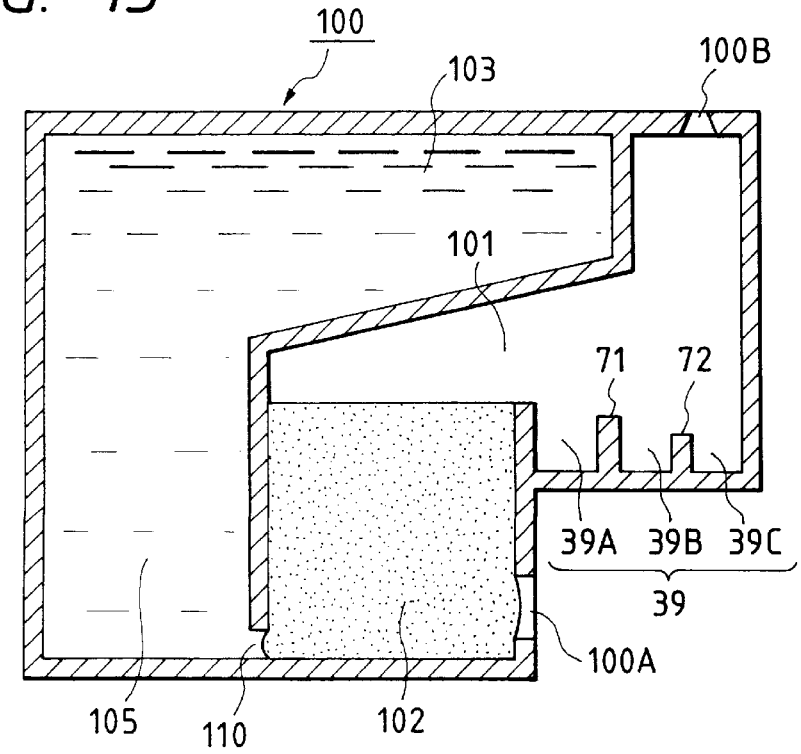
FIG. 13 is a cross-sectional view of an ink cartridge in another example of the present invention.

FIG. 13 is a cross-sectional view of an ink cartridge 100 in a further example.

In this example, the ink sink 39 is partitioned by two ribs 71, 72 into three sections 39A, 39B and 39C, wherein a rib 72 apart from the negative pressure generating member 102 is set to be lower than a rib 71 closer to the negative pressure generating member 102. In this way, by partitioning the ink sink 39 into plural sections, the ink residing inside thereof can be collected in stages to keep away from the negative pressure generating member 102, and therefore, when the ink cartridge 100 is mounted in use on the carriage of the printing apparatus, it is possible to keep the ink within the ink sink 39 from returning to the negative pressure generating member 102, owing to vibration of the carriage during the scanning. In addition, by partitioning the ink sink 39 into plural sections, the ink wave within the ink sink 39 produced by vibration can be suppressed. Of course, the number of partitions in the ink sink 39, or the form of partitions, is by no way limited to this example. Also, the form of ribs 71, 72 can be set to keep the ink within the ink sink 39 from returning to the negative pressure generating member 102. For example, by extending both ends of the upper portion of ribs 71, 72 slightly upwards along a side wall of the first containing chamber 101, the ink within the ink sink 39 can be detained and kept from returning to the negative pressure generating member 102, even if the ink cartridge 100 is inclined slightly.

By disposing the ink absorbing member 9 as shown in FIG. 9 in contact with at least part of an inner wall face of communication channel between the negative pressure generating member 102 and the atmosphere communication opening 100B, the ink 21 exuding from the negative pressure generating member 102 can be absorbed. Also, when a ridgeline portion is formed by plural inner wall faces in the communication channel between the negative pressure generating member 102 and the atmosphere communication opening 100B, the ink 21 can be efficiently absorbed into the negative pressure generating member 102 placed in contact with a part of the ridgeline.

Also, the ink cartridge 100 coupled with the ink-jet head 200 as shown in FIG. 12 may be replaceably mounted on the carrier of the ink-jet printing apparatus.

As above described, according to the present invention, even if the ink exudes from the negative pressure generating member within the first containing chamber as the air present within the second containing chamber undergoes environmental changes (temperature change, pressure change) in using the ink cartridge, the ink exuding up to a region between the negative pressure generating member and the atmosphere communication opening can be separated away from the negative pressure generating member by separating means provided at that region, thereby preventing the water head from increasing owing to the exuded ink from the negative pressure generating member, and maintaining the printing performance by supplying the ink always stably.

Further, by using an ink absorbing member as separating means, the exuded ink can be absorbed into the ink absorbing member, if the ink exudes from the negative pressure generating member owing to temperature changes during the physical distribution of the ink cartridge, and in unsealing the ink cartridge for use, the ink can be prevented from dripping out.

Note that the ink tank as shown in FIGS. 1A to 2 can be constituted in view of the following respects.

Figure 14A:
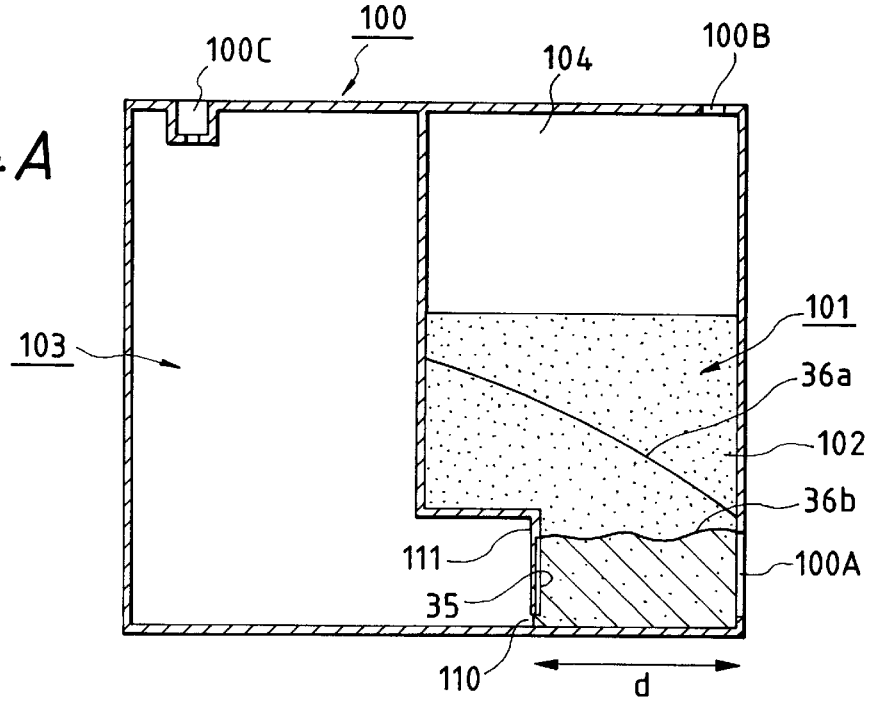
FIGS. 14A and 14B are cross-sectional views showing an ink cartridge in a further form of the present invention.

That is, as shown in FIG. 14A, the negative pressure generating member 101 is configured to have the partition 111 of a crank form to make the distance d between the communication channel 110 and the supply port 100A shorter. Also, a groove 35 is disposed to sufficiently maintain the ink level 36*b* in the distance d.

With this constitution, the ink supply is made stable to eliminate the risk of ink supply failure in the course of use. Also, a dynamic negative pressure generated in supplying the ink can be reduced. The dynamic negative pressure is a difference in pressure between the flow-in and flow-out portions, which is generated by a fluid resistance which is present therein, when the ink flows through narrow and complicate ink passageways such as the negative pressure generating member, this resistance being directly proportional to the length of ink passageways, and reversely proportional to the cross section thereof. That is, in this embodiment, the dynamic negative pressure can be reduced by having a shorter length and a sufficiently large cross section, whereby the frequency responsibility of the ink-jet head can be raised to fully cope with the fast recording. Note that the height of atmosphere introducing groove 35 is below, at or above a bent section of the partition 37.

Figure 14B:
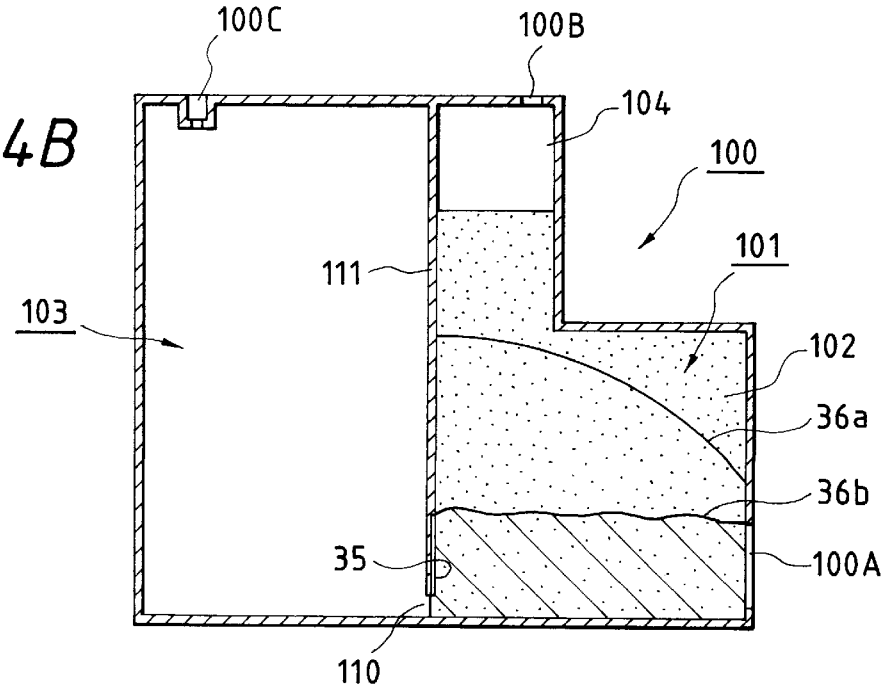

By providing a cut-out partly on the upper portion of the negative pressure generating member receiving chamber 101, as shown in FIG. 14B, a non-ink region (space) 104 present above an initial ink level 36*a* within the negative pressure generating member 102 can be reduced to form the minimum non-ink region as required only in the vicinity of the atmosphere communication opening 100B. Thereby, even if the ink is moved to the non-ink region within the negative pressure generating member 102, due to variations in environment during the long-term storage or physical distribution, the movement of ink to that non-ink region is restrained, because the non-ink region is relatively small, and the ink is not substantially moved, if the ink does not exist between the communication passage 110 and the supply port 100A.

Further, the ink storage rate per volume of tank is increased by an amount not involving such a non-ink region or a region contributing to holding the ink, whereby the ink cartridge with high ink use efficiency can be obtained.

Herein, the non-ink region 104 will be described below. The ink is filled into the ink cartridge under pressure via the ink inlet port 39, for example, as shown in FIG. 14B. First, the cartridge is turned upside down to fill the ink into the ink containing chamber 103 in the same figure. Further, the ink is poured under pressure via the communication channel 110 into the negative pressure generating receiving chamber 101, in which the ink within the negative pressure generating member 102 fans out around the communication channel 110. Therefore, when the negative pressure generating member 102 is rectangular, the non-ink region is increased, but in this embodiment, because the cut-out is provided on the negative pressure generating member 102, the non-ink region thus formed can be smaller. It is preferable for filling the ink that the ink supply port 100A is enclosed by a seal member (not shown) in pouring the ink.

Further, by taking a constitution in this embodiment, the atmosphere communication opening is located apart from the ink supply port, and closer to the communication channel of gas and liquid exchanging portion, making it difficult to cause the air from the atmosphere communication opening to enter into the ink supply port, so that the air can be smoothly introduced at the gas and liquid exchanging portion.

The ink tank as shown in FIGS. 1A to 2 is made by applying two constitutions as shown in FIGS. 14A and 14B, as well as disposing the ink containing chamber 103 having the shape less susceptible to limitations to surround the negative pressure generating member receiving chamber 101 to make the whole cartridge more rectangular, thereby making the whole shape more compact. Also, a buffer portion for forming a predetermined space between the negative pressure generating member 102 disposed and the atmosphere communication opening 100B is provided. In this way, by providing the region to which the ink is not moved, the non-ink region 104 within the negative pressure generating member 102 can be further reduced.

Herein, the filling of ink will be briefly described with reference to FIGS. 15A to 15C.

Figure 15A:
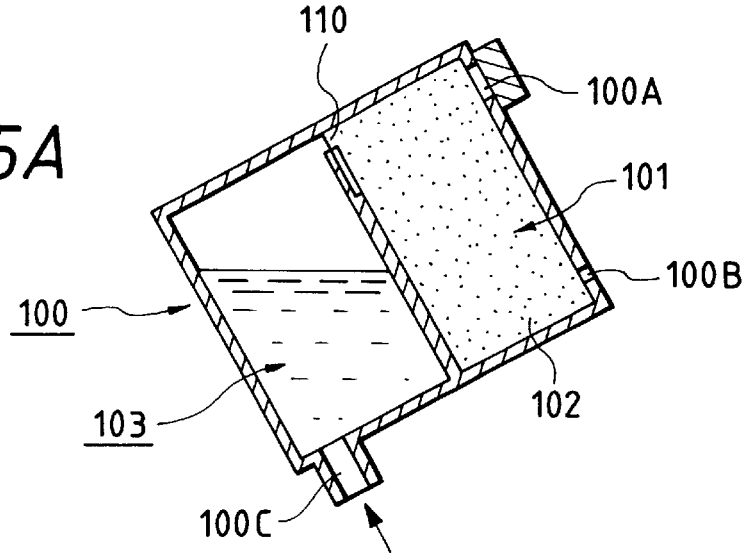
FIGS. 15A, 15B and 15C are views for explaining how to fill the ink into the ink cartridge.
Figure 15B:
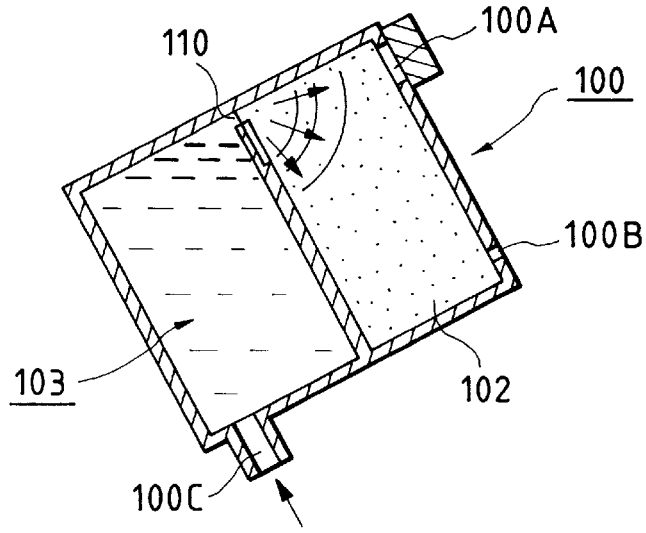
Figure 15C:
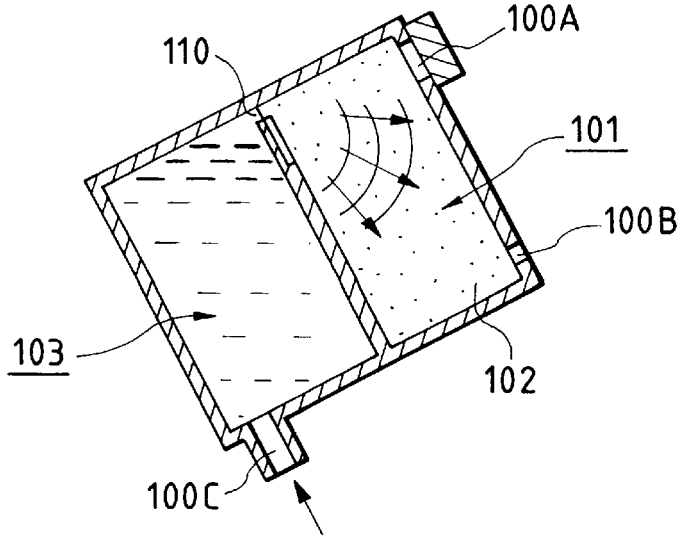

When the ink is poured via the ink inlet port 100*c* into the ink containing chamber 103, the gas within the containing chamber 103 is exhausted to pour the ink, normally the communication channel 110 being set at the highest level, as shown in FIGS. 15A to 15C. If the ink containing chamber 103 is filled with the ink, the negative pressure generating member 102 starts to be filled with the ink via the communication channel 110 (FIG. 15B). If the ink further continues to be poured, the ink spreads radially from the communication channel 110 within the negative pressure generating member 102, so that the ink within the negative pressure generating member 102 is filled in fan form, as shown in FIG. 15C.

As above described, according to the present invention, since the length between the communication channel and the ink supply passage can be shorter than that of the other portion of the negative pressure generating member, the ink supply capability between the communication channel and the ink supply passage is not hampered, even if there is an increase in volume of the negative pressure generating member accompanied by the larger capacity of cartridge.

Also, since the length of the negative pressure generating member can be shortened in the non-ink region, the amount of ink movable to the non-ink region can be restricted to relieve the effect of this movement imposed on the ink supply capability.

Further, since the atmosphere communication opening is located apart from the ink supply port, and closer to the communication channel in the gas and liquid exchange portion, the air from the atmosphere communication opening is less prone to enter into the ink supply port, so that the air can be smoothly introduced at the gas and liquid exchange portion.

As a result, the ink tank of larger size and having a greater amount of capacity can be realized with the improvements in the ink supply capability, the ink storage rate, and the negative pressure characteristic.

The ink tank as shown in FIGS. 1A to 2 has quite complex external and internal constructions, and is difficult to use techniques such as heat welding or ultrasonic welding, in manufacturing the ink tank, as previously described. Thus, it was noted to use a vibration welding technique for manufacturing the ink tank.

Figure 16A:
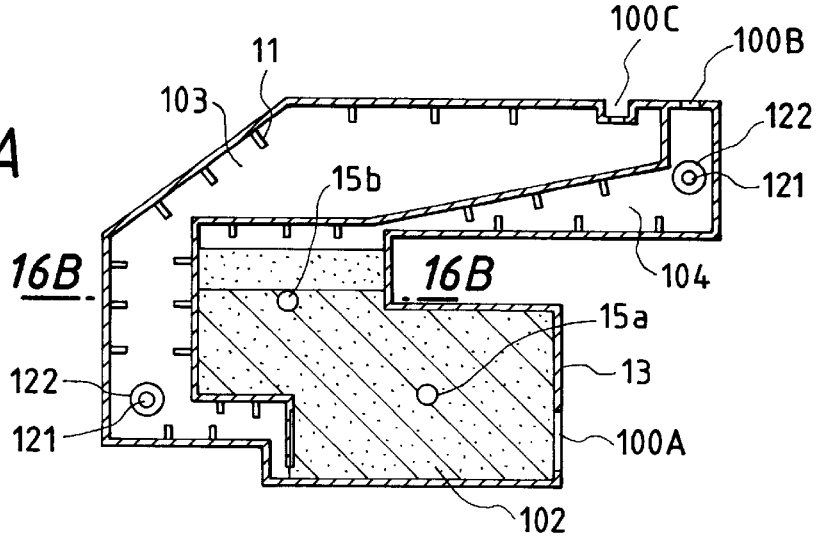
FIG. 16A is a cross-sectional view showing the relation, before welding, between a container and a lid which constitute the ink cartridge of the present invention.
Figure 16B:
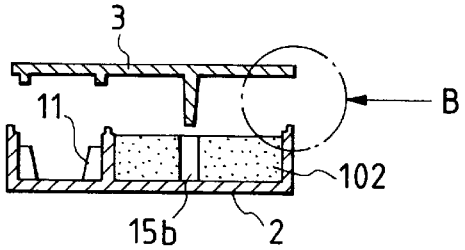
FIG. 16B is a cross-sectional view taken along the line 16B—16B in FIG. 16A.
Figure 16C:
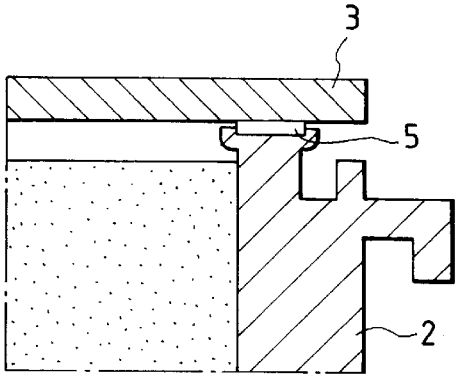
FIG. 16C is a cross-sectional view showing a joint between the lid and the container indicated by a B part in FIG. 16B, in larger scale.
Figure 16D:
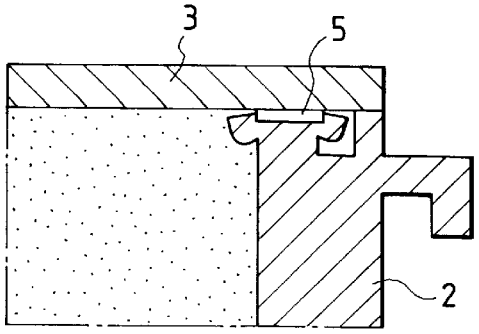
FIG. 16D is a cross-sectional view showing the joint after welding indicated by B part in FIG. 16B in larger scale.

First, the vibration welding will be described below with reference to FIGS. 16A to 16D. FIG. 16A is a cross-sectional view showing a container 2 constituting an ink cartridge of the present invention, FIG. 16B is cross-sectional view showing the relation, before welding, between the container 2 and a lid 3 constituting the ink cartridge of the present invention, taken along the line 16B—16B in FIG. 16A, FIG. 16C is a cross-sectional view showing a joint between the lid 3 and the container 2 in larger scale, and FIG. 16D is a cross-sectional view showing the joint after welding in larger scale.

Now, the lid 3 is set to an upper jig 9 (not shown), and the container 2 is set to a lower jig 8 (not shown). The upper jig 9 is vibrated in a direction of vibration B with the container 2 and the lid 3 contacted with each other in the process of welding. In FIG. 16C showing the joint between the lid 3 and the container 2 in larger scale, the lid 3 and the container 2 are fused due to frictional heat generated by the friction produced at the joint 5. The upper jig 9 presses the lid 3 against the container 2 with a predetermined force, to weld the lid 3 and the container 2 together in a predetermined positional relation as they are fused. The vibration is stopped if the welding proceeds up to a state of FIG. 16D, in which the jig is fixed until the welding part cools and is solidified again. In such process, the ink cartridge is formed by vibration welding. The condition of vibration was set as follows in the present invention, although there are some proper values according to the prerequisites such as the size and shape of tank and the amount of welding.

The higher frequency of vibration can shorten the welding time, since the elevated temperature can be determined by the balance between frictional heat generated and heat diffusion. Also, too high frequency will affect the follow-up capability of the lid 3, and in some instances, the tank after welding was distorted by strain produced due to less sufficient strength of the lid 3. In the present invention, the desired welding was accomplished under the set condition from 30 to 2000 Hz, but it was supposed that the mass production at 100 to 500 Hz was satisfactory, in view of greater stability of the process. Accordingly, the best mode was at 250 Hz. It was found that the vibration time (weld time) requires about 1.0 sec or more to fuse 0.88 mm without producing leakage in the present invention, depending on the amount of welding. Further, since a too long vibration time causes the final shape to deviate from the design value, the vibration time was set below about 20 sec. Since the preferable condition in view of mass productivity was from 2 to 5 sec, it was confirmed that the optimal vibration time was 3.6 sec. The longer holding time (hold time) after vibration, the better solidification results, with more stable shape, but it was found that with the holding time of 0.5 sec or greater, the stable area can be substantially obtained. The amplitude limiting timing can be started before the lid 3 and the container 2 are joined, but in the present invention, it was discovered that the members can behave less roughly by oscillating the lid 3 and the container 2 after they are joined and pressed to some extent. The smaller welding pressure will generate less frictional heat, but too great welding pressure will produce too big frictional force, by which the container an the wall 4 are defeated to result in a so-called wall collapse state where the lid 3 and the container are vibrated at the same time, in which no frictional heat is also generated. Accordingly, in the present invention, it was necessary that the welding pressure is limited within a range from 5 psi to 50 psi. In practice, a welding pressure from 20 psi to 40 psi was preferable in respect of mass production, and optimally 30 psi. The amplitude is related with the frequency-of vibration, wherein the frictional heat will elevate the temperature at the welding part efficiently as two members are placed at a certain relative speed on the friction face, while in the present invention, the welding force was set to be 3 mm or less, because if too big welding force is applied, two members may be bulged out of the welding margin. Also, it was set to be 0.5 mm or greater, because too small force is difficult to reach the welding temperature. More preferably, it was from 1 mm to 2.5 mm, and at the best mode, it was 1.75 mm.

The lid 3 and the container 2 may be relatively moved, but it is preferable to set the lid 3 to jig on the side of excitation, because the smaller, lighter and stronger member can follow the vibration more efficiently. The material of members used in the present invention was polypropylene (PP), but other materials may be used, including resin materials such as polyethylene, polystyrene, polycarbon, polyphenylene oxide (Noryle; trade mark by GE), ABS (acrylonitrile-butadiene-styrene), PET (polyethyleneterephthalate), and fundamentally any material such as metal or glass, as long as the member can be thermally fused under the condition where the temperature is elevated up to a melting point by frictional heat.

Figure 17A:
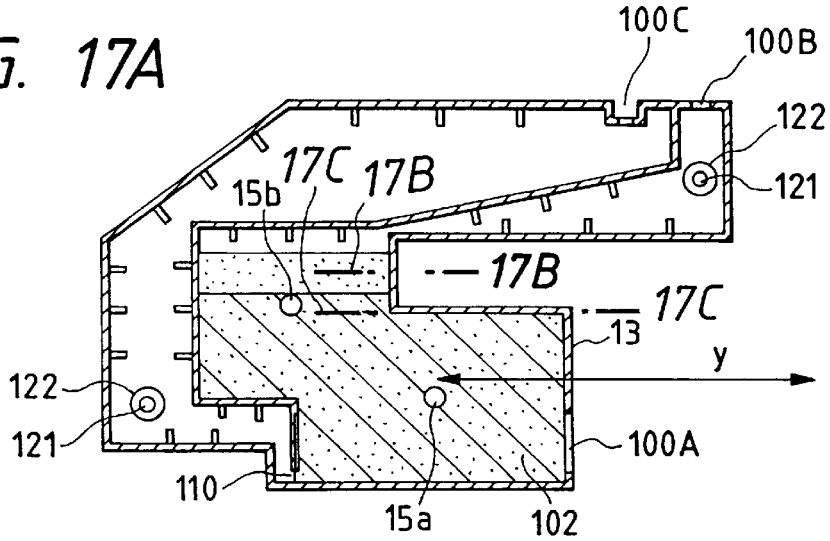
FIG. 17A is a cross-sectional view showing a container constituting the ink cartridge of the present invention.
Figure 17B:
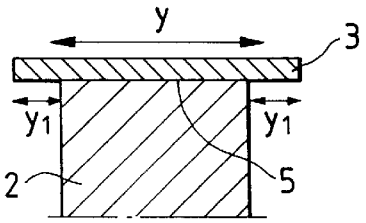
FIG. 17B is a cross-sectional view taken along the line 17B—17B in FIG. 17A, before welding the container and the lid.
Figure 17C:
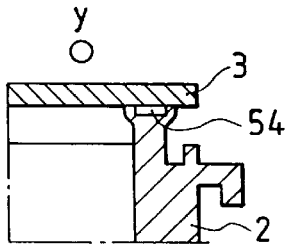
FIG. 17C is a cross-sectional view taken along the line 17C—17C in FIG. 17A, before welding the container and the lid.
Figure 17D:
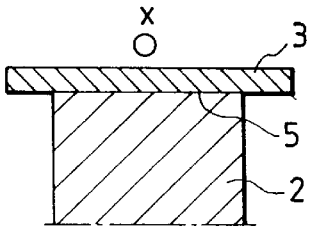
FIG. 17D is a cross-sectional view taken along the line 17B—17B in FIG. 17A, while welding the container and the lid.
Figure 17E:
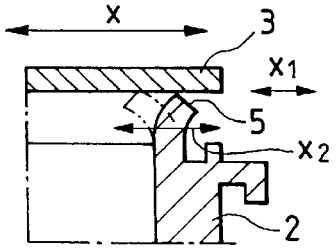
FIG. 17E is a cross-sectional view taken along the line 17C—17C in FIG. 17A, while welding the container and the lid.
Figure 17F:
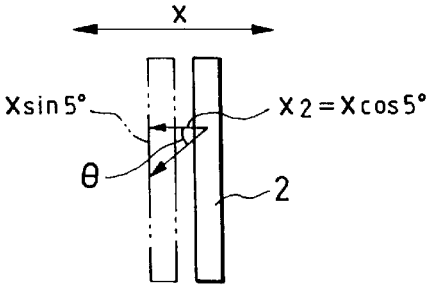
FIG. 17F is a cross-sectional view for explaining the vibration direction.

One of the important factors concerning the shape of ink cartridge among the welding conditions is a vibration direction. In a case of the shape of FIGS. 1A to 1C in this embodiment, if the vibration occurs in y direction, the wall lying in the same y direction is hardly collapsed, resulting in quite excellent weldability, while the wall lying vertically may be collapsed by frictional force against the vibration. This is shown in FIGS. 17A to 17F. FIG. 17A is a cross-sectional view showing a container making up the ink cartridge of the present invention, FIG. 17B is a cross-sectional view showing a state before welding of the container and the lid, taken along the line 17B—17B in FIG. 17A, FIG. 17C is a cross-sectional view showing a state before welding of the container and the lid, taken along the line 17C—17C in FIG. 17A, FIG. 17D is a cross-sectional view showing a state during welding between the container and the lid, taken along the line 17B—17B in FIG. 17A, FIG. 17E is a cross-sectional view showing a state during welding between the container and the lid, taken along the line 17C—17C in FIG. 17A, and FIG. 17F is a cross-sectional view for explaining the vibration direction.

When the vibration direction y is in a longitudinal direction of the wall 2 as shown in FIGS. 17B and 17C, substantially no wall collapse occurs, and the friction distance $y_1$ is equal to $yy_1$ for the amplitude y, with substantially no loss.

However, if the wall collapse $x_2$ is caused by vibration x, the substantial friction distance $x_1$ is equal to $x-x_2$, as shown in FIGS. 17D and 17E, which means that a large loss may result depending on $X_2$. In this case, $y=y_1$, $x=x_2$, from which it follows that the wall collapsed in x direction has been welded falsely. Herein, supposing that the angle in the longitudinal direction of all container walls is $\theta=5°$ or greater relative to a direction perpendicular to the vibration direction in the present invention, $y_1=y \cos 5°=99.6[\%]$, and $x_1=x \sin 5°=8.7\ xx[\%]$, resulting in a friction distance perpendicularly to the x direction, whereby the welding can be effected by controlling other welding conditions, as shown in FIG. 17F. In practice, for θ greater than 0, the effects of the present invention can be obtained, and if the difference in angle between respective walls is too large, the unbalance in welding condition may occur unfavorably. This is because the sealing ability of tank is regulated to account for the worst welded portion. Accordingly, it is preferable to dispose respective walls at smaller angles to the amplitude direction to reduce the difference thereof. Further, in the present invention, the angles of all walls were designed so that the vibration angles θ be all 45° or below. Thereby, the application of vibration energy to all the walls was enabled at a high efficiency of sin 45°=70.7 or greater and with good balance. This is because when the vibration direction was determined at an angle y' of 45° to the vibration direction y, all the walls for the ink cartridge 100 were designed to be at 45° or below to the vibration direction, resulting in the relatively stable welding.

Further, in the present invention a method of welding by vibration while changing the vibration direction, with the vibration direction of a vibration jig 9 being made θ=0° to each wall for better welding, has been proposed. In the course of oscillation, it is possible to make welding while changing the vibration in all directions (e.g., rotational direction), since the welded portion may be in heavily molten state, but the welding can be efficiently made by applying the vibration only in the longitudinal direction of wall to the wall portion of the container 2 of the ink cartridge 100. If the vibration direction is limited, the frictional heat generation amount per unit time can be increased by eliminating the vibration loss at other angles with larger loss, so that the melting point of material can be more rapidly reached.

A stiffening rib 11 in FIG. 16A has allowed reduction of energy loss produced. That is, since the outside of the wall of container 2 is closely contacted by the lower jig 8, it is possible to resist against a force tending to collapse the wall outward, but difficult to resist against a force tending to collapse the wall inward, conventionally a measure of making the wall thicker was taken. However, there was a problem that the ink storage rate relative to the internal volume of tank in the ink cartridge may be decreased by an amount of increased wall thickness, resulting in reduced ink use amount for the tank cost. In the light of this problem, the present invention can prevent collapse of the wall by providing the wall 2 with the stiffening rib 11 having a smaller volume than the increased volume of wall which has been thickened. Further, remarkably, the present invention has realized an ink cartridge in which the ink flow C is smoother, with extremely less residual amount of ink, and constructed in greater strength by adopting a trapezoidal shape of stiffening rib 11, like the stiffening rib 11 as shown in FIG. 16A, despite the complicate shape of the ink containing portion 103.

Figure 18A:
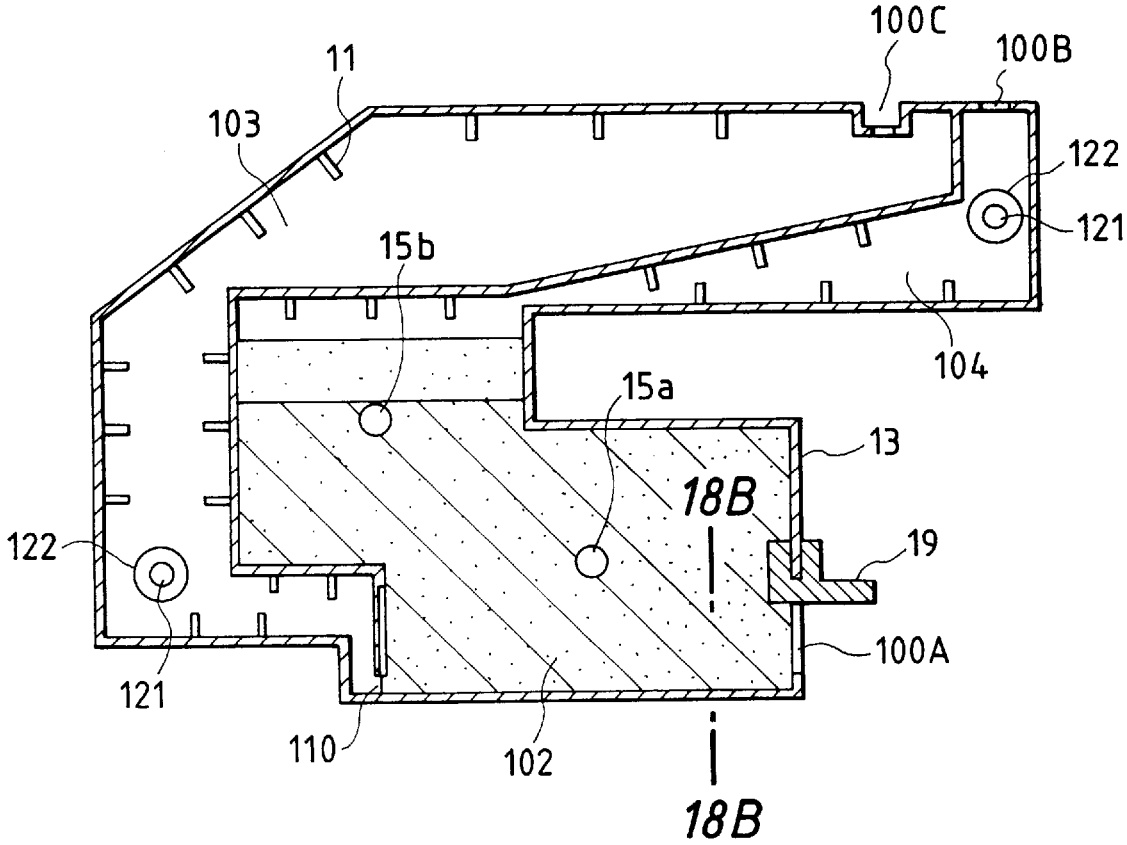
Figure 18B:
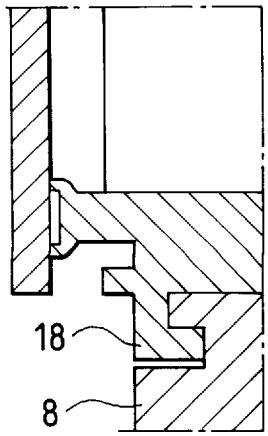

As in this embodiment, the ink cartridge which can give rise to effective ink properties by placing the negative pressure generating member 102 into fully close contact with the tank wall 2 can not adopt the constitution as shown in FIGS. 17A to 17F in this portion. Therefore, an L-shaped character type jig clamp portion 18 is provided on a whole or a part of the wall 11 of the container in the portion for receiving the negative pressure generating member 102, and secured to the lower jig 8 to prevent wall collapse inward, as shown in FIG. 18B. FIGS. 18A and 18B are views for explaining wall collapse preventing means, in welding by vibration, respectively, wherein FIG. 18A is a cross-sectional view showing a case where wall collapse is prevented by inserting a jig through the opening portion of ink cartridge, and FIG. 18B is a cross-sectional view taken along the line 18B—18B in FIG. 18A, as shown in a form as will be described later. In FIG. 18B, the L-character type jig clamp 18 is shown, but any clamp is usable as far as it is clamped integrally with the lower jig, with the variable shape to have the same function. Further, this portion may be removed after welding, if unnecessary.

In a case where the stiffening rib is not provided inside the wall of the negative pressure generating member receiving portion, as shown in FIGS. 18A and 18B previously referred to, a method is taken in which the collapse of container wall 2 inward is prevented by inserting an L-shaped character clamp jig 19 through an opening portion of tank, as shown in FIG. 18A. This can not be easily adopted for the portion remote from the opening, but is a more effective method because the deletion process after welding is unnecessary.

This embodiment is a welding method in which the same material as used for the tank, or the material having the same melting point is used, or the welding condition is controlled such that the welding temperature may be higher than the melting points of materials.

Figure 19A:
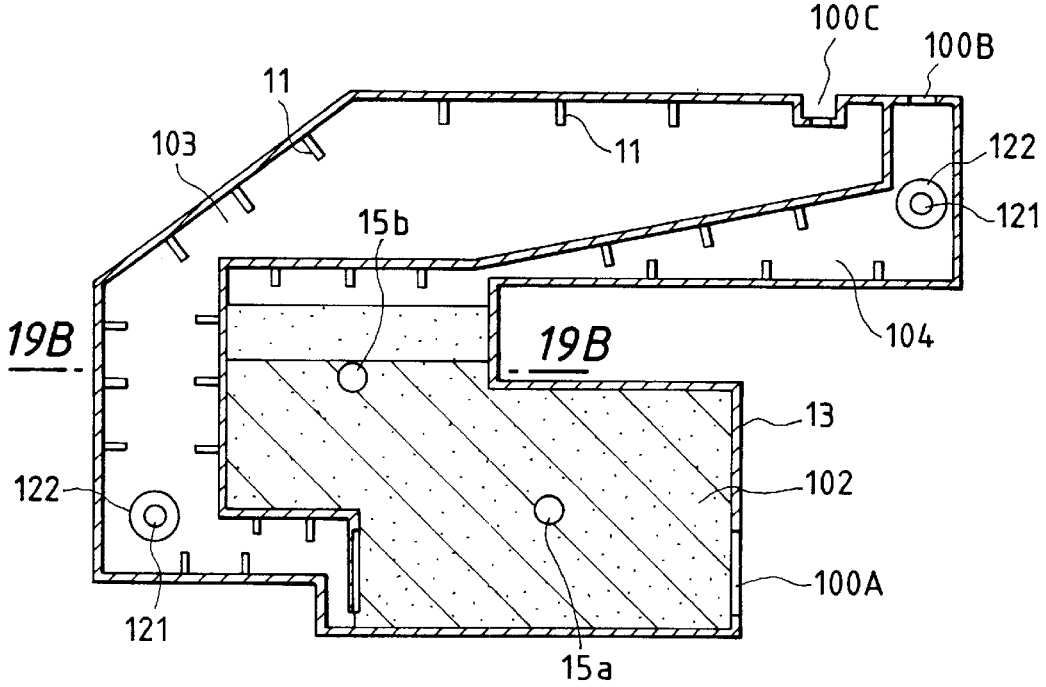
FIG. 19A is a cross-sectional view showing the relation, before welding, between the container and the lid which constitute the ink cartridge of the present invention.
Figure 19B:
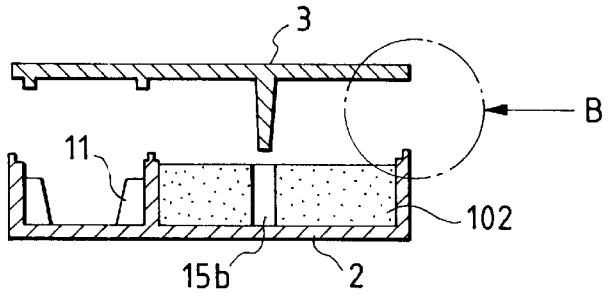
FIG. 19B is a cross-sectional view taken along the line 19B—19B in FIG. 19A.
Figure 19C:
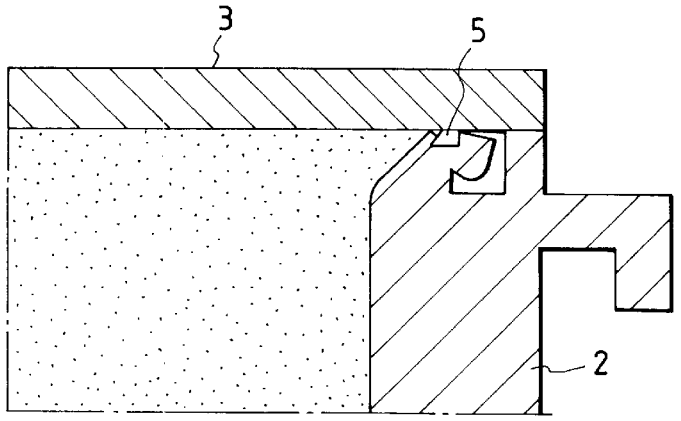
FIG. 19C is a cross-sectional view showing a joint between the lid and the container indicated by a B part in FIG. 19B, in larger scale.

In a vibration welding method of welding by transverse vibration for use with the present invention, since the vibration is applied transversely as shown in FIGS. 19A to 19C, the negative pressure generating member 102 may be pulled into the welding portion 5, and consequently pinched between the welding parts, resulting in poor sealing ability of the tank, when the lid 3 is vibrated to the left in FIGS. 19A to 19C. This possibility is particularly high from the following reason. That is, it is preferable in respect of mass production to carry out the welding process more efficiently and for shorter time, but for this purpose, it is effective to make the amplitude greater. Also, to raise the close contact between the lid 3 and the negative pressure generating member 102, it is desirable in respect of functionality to provide the negative pressure generating member 102 which is higher than the wall 2 after the end of welding. However, the above two points will raise the possibility of pinching at the welding parts, wherein the mass productivity and the air tightness of tank were inconsistent. However, the present invention allows the mass productivity to be consistent with sealing ability, because the sealing ability at the welding part can be secured by fusing the pinched member together.

The close contact between the tank wall and the negative pressure generating member or the density distribution of negative pressure generating member is a quite important factor for the performance of ink-jet tank. In this embodiment, control of the close contact or density distribution is efficiently performed through the welding process.

Figure 20:
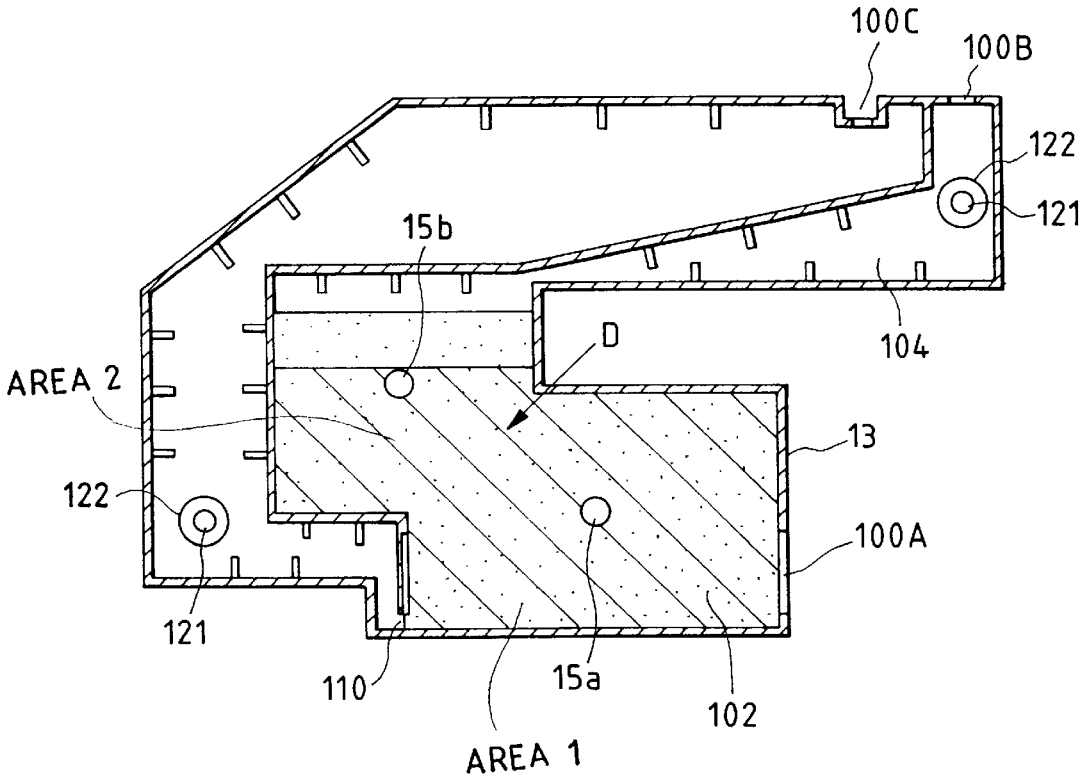
FIG. 20 is a cross-sectional view showing the constitution of an ink cartridge for explaining last stroke direction at the time of vibration welding.

In FIG. 20 showing a cross-sectional view of an ink-jet cartridge, the oblique line portion is an area having significant meaning from the respects of the ink supply capability to the head and the reliability of head against ink dripping. With these areas 1) and 2), a desired negative pressure can be applied to the recording head 2101 by shutting off the gas and liquid exchange portion 110 from the outer air by the negative pressure generating member 102 to generate a negative pressure in the negative pressure generating member 102. Also, in area 2), the density of other negative pressure generating member is raised to attain the higher ink retaining ability and the stable ink supply capability to the recording head 2101. Therefore, in this embodiment, vibration is stopped in a direction of the arrow D at the last stroke in welding by vibration, to make stable the contact of the container wall 2 of ink tank with the area 1) and area 2), thereby realizing a relatively high density of the area 2). With this method, the tank performance during the welding process could be enhanced.

In FIG. 20, at least one sponge clamp bar 15*a*, 15*b* is clamped to a member on the side of vibrating the negative pressure generating member 102, or the lid 3 in this embodiment, to provide more controllability over the movement of the negative pressure generating member 102, and the enhanced effect in the form as shown in FIG. 20. Further, at least two or more sponge clamp bars allow unconstrained of the negative pressure generating member 102 so that the negative pressure generating member is not subjected to rotational force to produce the areas 1) and 2) in other than the desired portion.

Herein, it is important that the clamp bar has a shape extending in a direction of inserting the negative pressure generating member, and is desirably not an obstacle in receiving the negative pressure generating member within the container.

Figure 21:
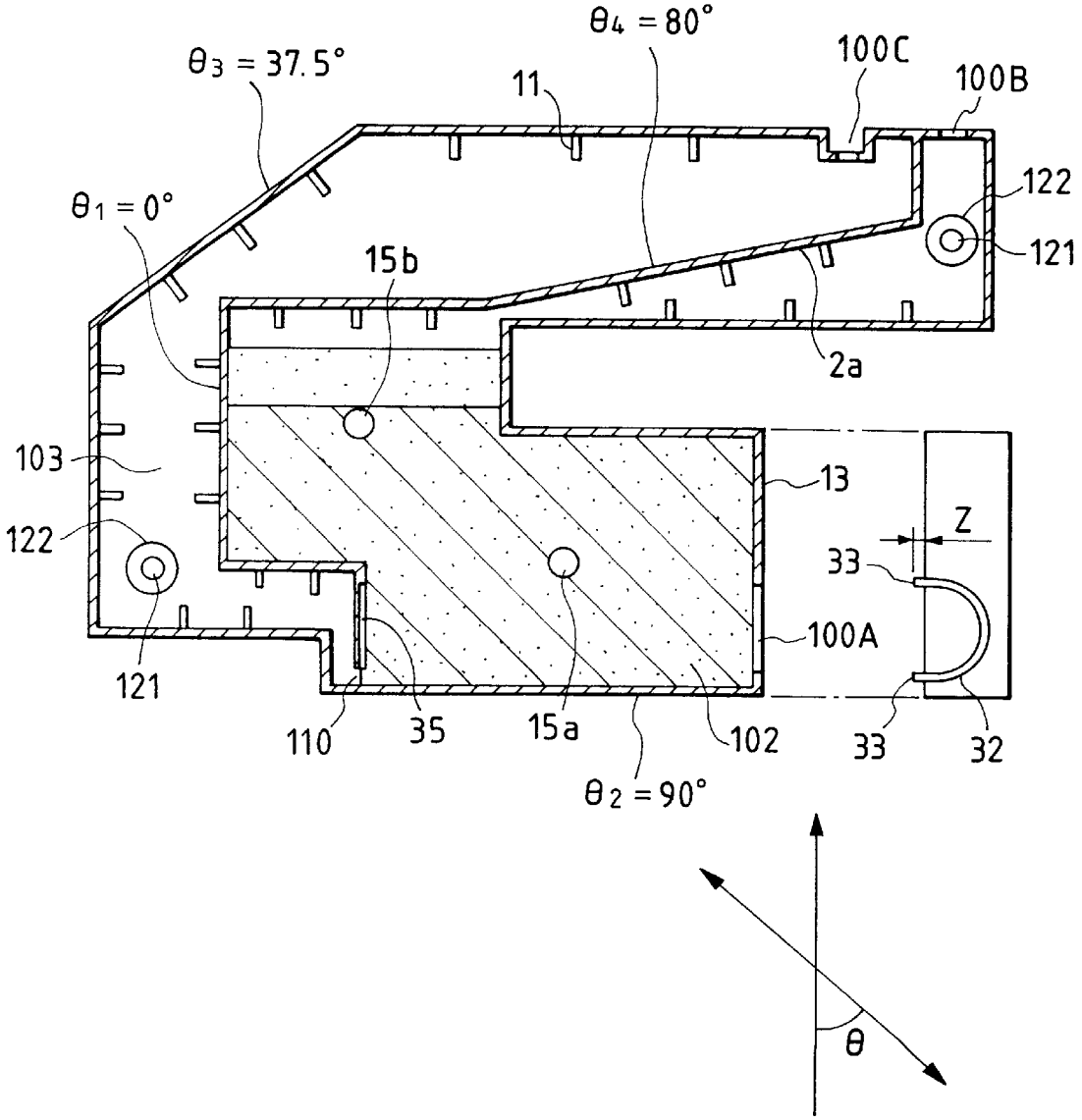
FIG. 21 is a cross-sectional view of a replaceable-type ink cartridge in a further example of the present invention.
Figure 22:
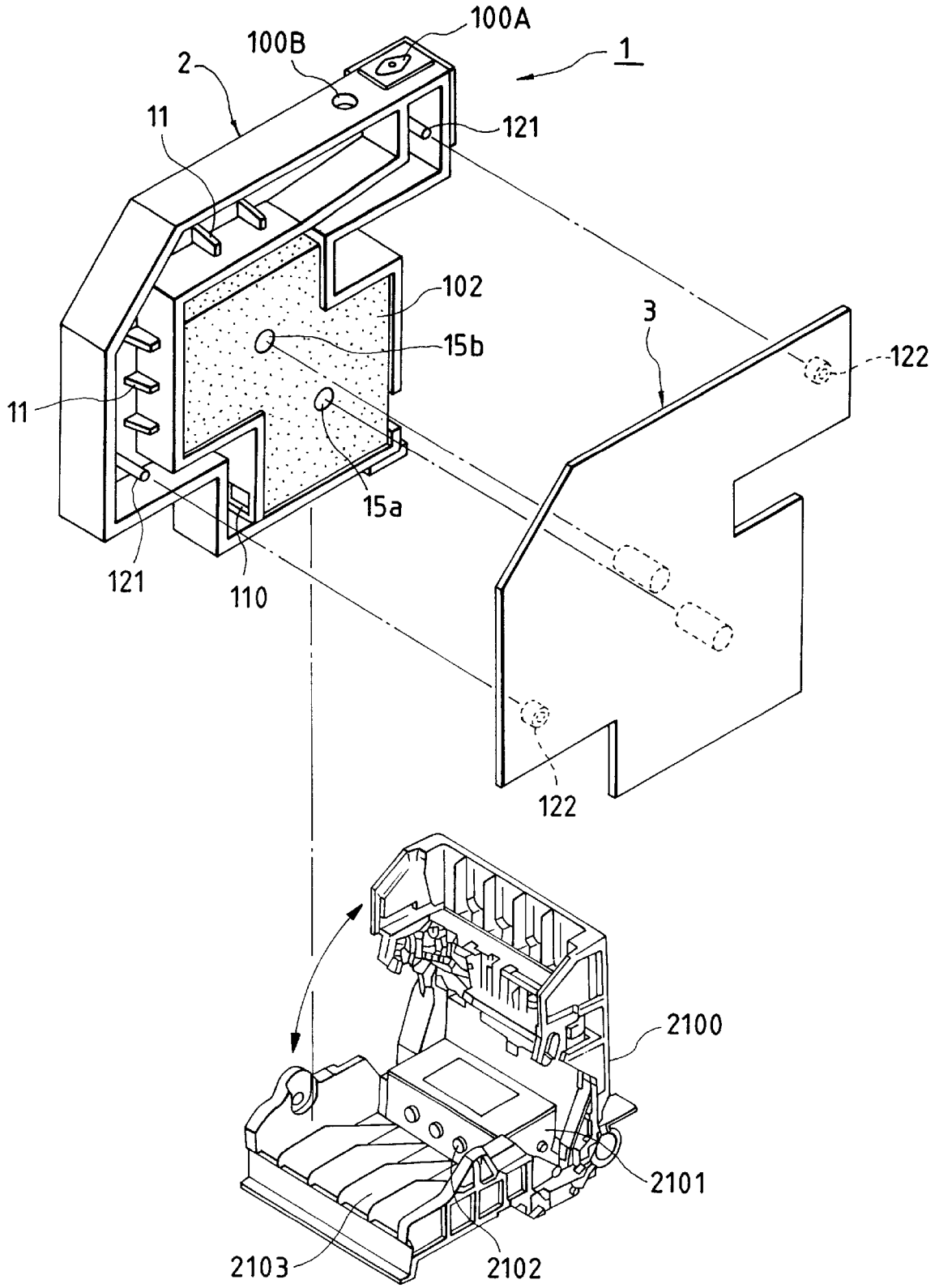
FIG. 22 is an exploded perspective view of the ink cartridge of FIG. 21 and a head cartridge, as well as a carriage for scanning, having them mounted thereon.

In this embodiment, a vibration suppressing pin 121 and a suppressing barrel 122 are illustrated in FIGS. 21 and 22. Thereby, a movable area by engagement between the pin and the barrel can be defined to prevent the welding outside the welding region, or more production of welding burrs due to amplitude more than necessary in welding by transverse vibration, whereby the positional relation between the container 2 and the lid 3 can be precisely controlled.

The movable area in this case can be defined by the outer diameter of pin and the inner diameter of barrel, and it is preferable that the difference between diameters is as large as about 1.75 mm for definition of the best mode of amplitude of 1.75 mm as previously described, but it is also permitted to define them at the amplitude level as previously described, with sufficient effects having a margin of about 3 mm or less.

Figure 23A:
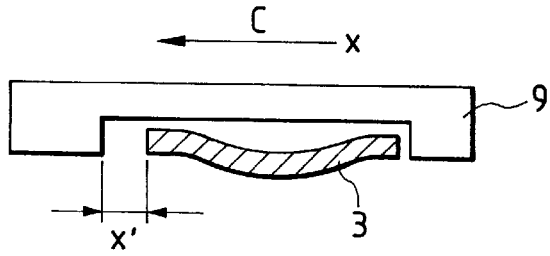
FIG. 23A is a cross-sectional view showing a state where the higher the frequency and amplitude, the less conformable the lid 3 becomes due to insufficient strength, lowering the transmission efficiency of vibration.
Figure 23B:
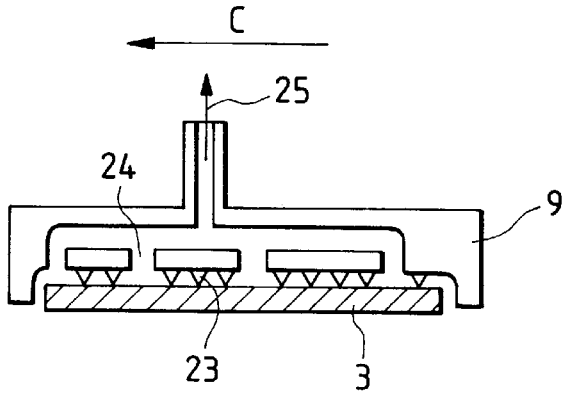
FIG. 23B is a cross-sectional view showing a mechanism for assisting in integration between an upper jig and the lid.

It is desirable in respect of the welding efficiency that the upper jig 9 producing vibration and the lid 3 are completely integrated and vibrated at the same time, but in some cases, the lid may be distorted due to a factor such as insufficient strength of lid, resulting in poor integration. With this tendency, if the number of vibrations and the amplitude are increased to enhance the welding capability, the lid 3 is more difficult to follow up due to insufficient strength, resulting in lower transmission efficiency of vibration. This behavior is illustrated in FIG. 23A. Now, if vibration is applied in direction B, because the transmission point to the lid 3 only occurs at the right side portion of the lid for the movement of the upper jig 9, the lid may be distorted, spending more time to transmit energy over the entire lid 3, resulting in a deficiency of x' for the amount of movement x due to delay of transmission to the left side of lid. In FIG. 23A, this phenomenon is shown exaggeratedly, in which significantly large transmission loss may be produced in the high frequency region or with the larger lid, and more liable to welding failure. Further, in this case, if the natural frequency of lid and that of the welding vibration are coincident or in exact multiple relation, resonance will arise, so that an abnormally great stress is applied on a part of the lid 3, possibly causing a clack. In FIG. 23B, the upper jig 9 and the lid 3 are provided with an integration promoting mechanism to solve the above problem. That is, the whole of the lid 3 is secured against the vibration by fine pawls 23 to provide better integration. Further, the upper jig 9 and the lid 3 are more closely contacted via vacuum openings 24 to provide a more integrated state. By adopting either of these two countermeasures, the effect can be favorably exhibited to allow for the enhanced mass productivity and reliability.

Figure 24:
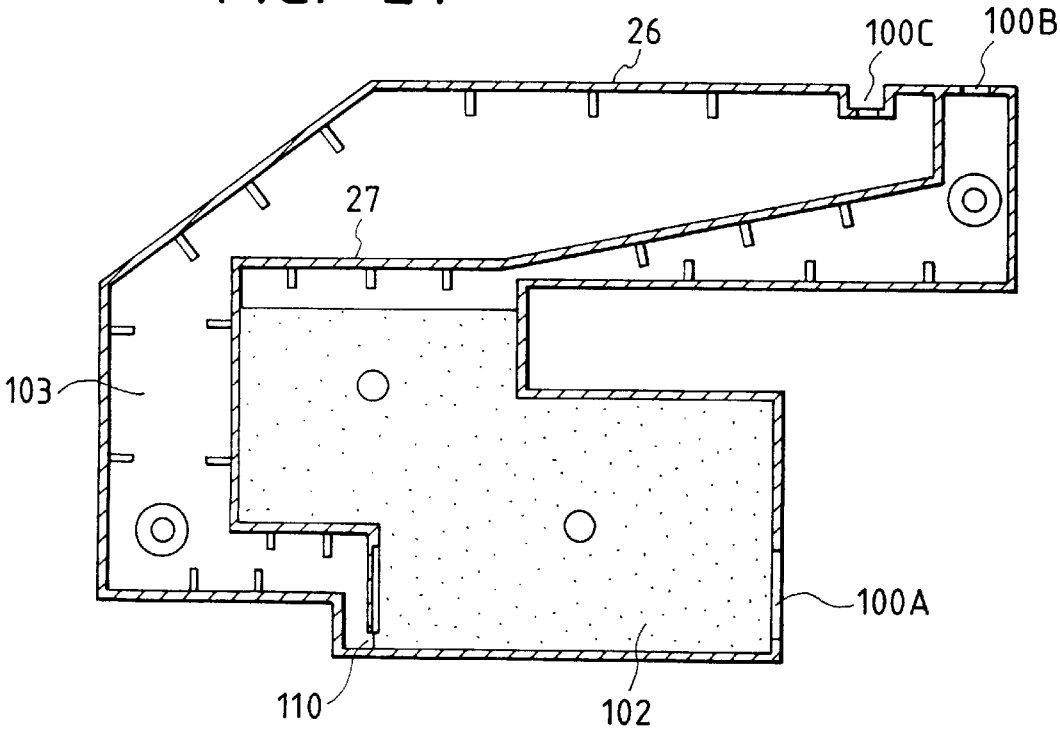
FIG. 24 is a cross-sectional view showing the state of welding check on a welding line without branch.

In this embodiment, a check is performed to see whether or not the welding of the ink cartridge of the present invention has been completely made. In the constitution of the invention as previously described, a welding margin is comprised of an outer peripheral portion 26 and a partition portion 27, as shown in FIG. 24. Normally, a method of checking for the sealing ability of welding includes checking the leakage by forcing the air through the ink supply port 100A, with the ink inlet port 100C and the atmosphere communication opening 100B tightly enclosed, and then measuring the change in internal pressure of the tank, but in the case of welding the partition portion 27 as in the present invention, there was no method of checking for the welded state at the partition portion 27. Therefore, it was obliged to rely on a method which may damage the component, such that if the partition portion is not broken by undergoing the stress caused by increasing the air pressure in checking the leakage, that component is regarded as non-defective. This is because the tank is comprised of the ink containing portion 103 and the portion for receiving the negative pressure generating member 102, which are in communication via the communication channel 110, but the sealing ability of partition portion in this tank is requisite in terms of the functionality.

However, a failure may be detected after filling the ink, because the welding state can not be checked, resulting in a wasteful process for the defectives.

Figure 25:
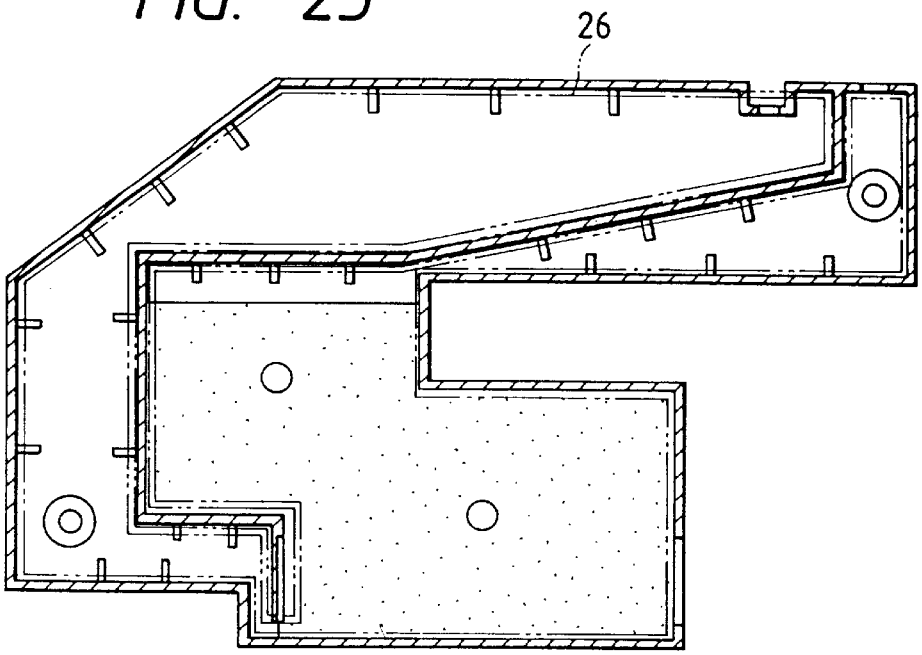
FIG. 25 is a cross-sectional view showing the state of welding check on the welding line without branch.

However, the above problem was solved by taking a shape of one ring for the welding portion, as shown in FIG. 25. That is, the branch portion at the welding part was eliminated by a simple ring configuration of the welding part, whereby the welding capability was confirmed through the same examination for leakage to allow the defectives to be checked before passing them to the next process.

Figure 26:
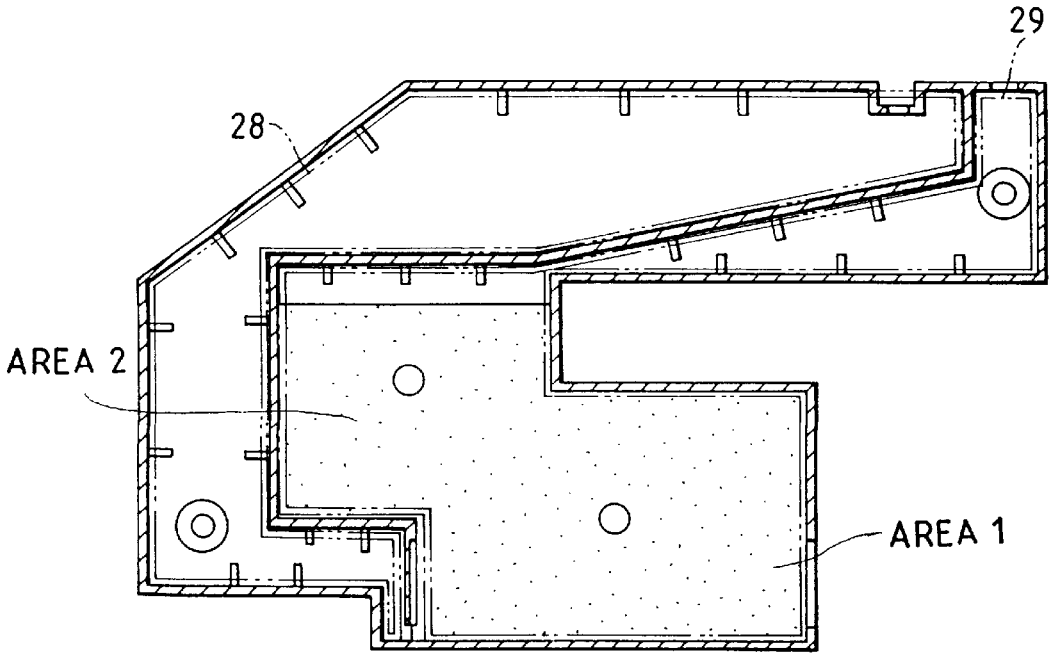
FIG. 26 is a cross-sectional view showing the state of welding check on the welding line without branch.

Also, similarly, the same effect can be expected by dividing an ink containing portion welding line 28 and a negative pressure generating member buffer portion welding line 29 into two rings, as shown in FIG. 26, in which this constitution is more effective for the ink having smaller surface tension of the ink contained (35 dyn/cm or less). Namely, for the ink having smaller surface tension, due to very strong capillary force, the ink is infiltrated into welding burrs produced in welding, and the ink in the ink containing portion is swiftly moved into the negative pressure generating member 102 or the buffer portion 104 in some cases. However, each welding part takes an independently closed configuration to prevent the movement of ink, resulting in an ink cartridge with high stability for storage, as shown in FIG. 26. In this case, the communication channel 110 is separated away from the welding part, in the middle of the wall 2, as shown by way of a cross section. This communication channel 110 can be formed as an opening by forming a cut-out on the partition wall of the container 2, and attaching the lid 3 to this container 2. Also, in molding, use of a slide core allows the formation of an opening inside the partition wall or a concave portion such as a groove of partition wall.

Note that the burr groove serves to recover the defectives which have less welding capability or were falsely welded by flowing a welding agent to extend around the entire periphery of the welding part, using the capillary force of burrs in this groove, while confining the burrs by melt produced from the welding part in welding not to move outward, and also can be employed to enhance the reliability of non-defectives. Further, as means for preventing the ink from sticking to the burrs and extending over the entire periphery of tank due to capillary force, an adhesive or sealant can be applied partly to the burrs as effective means for preventing staining of the user's hands. Further, this burr groove covering all burrs can also serve to prevent staining of the user's hands with the ink.

In FIG. 21, the supply port 100A is formed by the container 2 and the lid 3. This supply port can be sealed by a sealing member such as an Al seal during the physical distribution of ink cartridge. However, if the welding part of the supply port 100A formed of two members is in insufficient contact, the ink may leak due to floating of the welding part, even if it is sealed with the Al seal. Therefore, in the present invention, if the welding part may be floated, the supply port welding margin 33 is raised by more than the floating amount of welding part so that the sealing margin 32 of the supply port 100A may take a completely closed configuration. Further, to enhance the reliability, the width of this supply port welding margin is made Z=0.2 mm to 1.5 mm to eliminate the leakage.

Figure 27A:
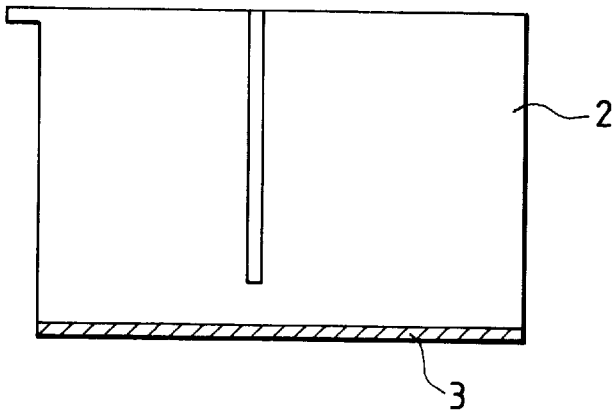
Figure 27B:
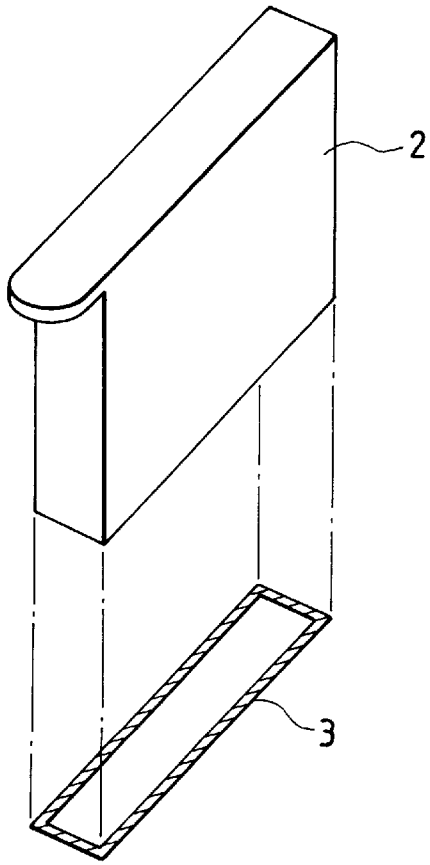

The present invention is also effective for the tanks of the type where the lid member as shown in FIGS. 27A and 27B is welded from the underside, rather than from the lateral face.

Also, this invention is effective for the ink cartridge without the negative pressure generating member and primarily containing only the ink, or the ink cartridge without the ink containing portion and comprised of the negative pressure generating member receiving portion alone.

Also, the constitution as set forth in the embodiment is sufficiently effective even singly, compared with the conventional example, but more effective by combining several or all constitutions.

Figure 28:
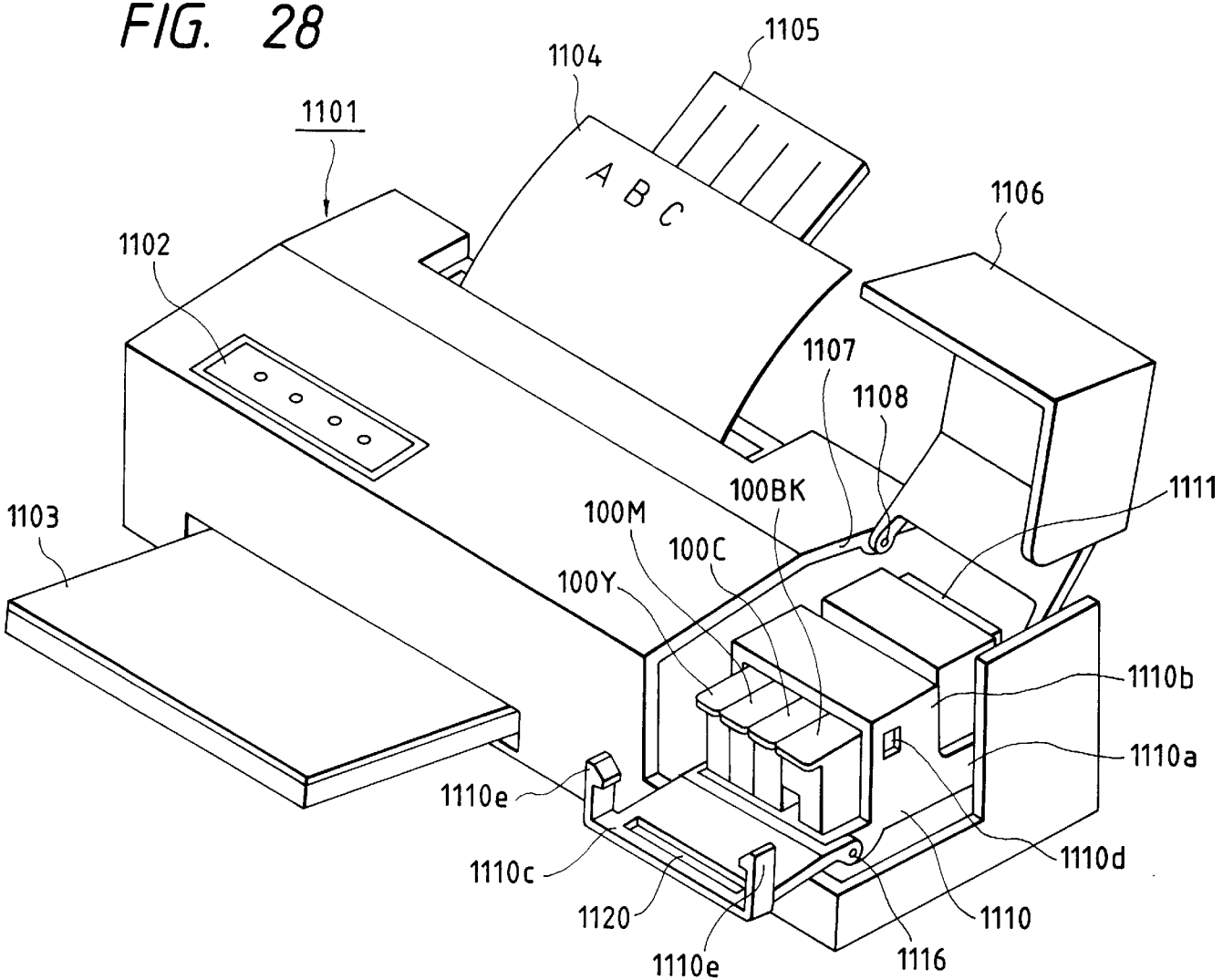
FIG. 28 is a perspective view showing a printer as an ink-jet recording apparatus using an ink cartridge of the present invention.

FIG. 28 is a perspective view showing a printer as an ink-jet recording apparatus using the ink cartridge according to the present invention.

1101 is a printer, 1102 is an operation panel provided on a front upper face of a housing for the printer 1101, 1103 is a paper supply cassette attached through an opening on the front face of the housing, 1104 is a sheet (recording medium) supplied from the paper supply cassette 3, and 1105 is a paper exhausting tray for holding the sheets exhausted along a paper conveying passageway within the printer 1101. 1106 is a main cover of L-shaped character in cross section. This main cover 1106 covers an opening portion 1107 formed in a right front portion of the housing and is rotatably attached to the inner end of the opening portion 1107 by a hinge 1108. Also, inside the housing, there is provide a carriage 1110 supported by a guide (not shown). The carriage 1110 is provided reciprocatively in a width direction of the sheet passing through the paper conveying passageway, i.e., along a longitudinal direction of the guide, not shown.

The carriage 1110 in this embodiment is substantially constituted of a stage 1110*a* held horizontally by the guide, an opening portion (not shown) formed on this stage 1110*a* in the vicinity of the guide for attaching the ink-jet head, a cartridge garage 1110*b* for receiving the ink cartridges 100Y, 100M, 100C and 100Bk mounted on the stage 1110 in front of this opening portion, and a cartridge holder 1110*c* for preventing separation of the cartridges received in this garage 1110*b*.

The stage 1110*a* is slidably supported on the guide at its trailing end portion, the lower side at its front end portion being attached on the guide, not shown. Note that this guide plate may serve as a paper holding member for preventing floating of the sheet conveyed along the paper conveying passageway as above described, or may serve to lift the stage in cantilevered style from the guide in accordance with the thickness of sheet.

To the opening portion of the stage 1110*a,* an ink-jet head (not shown) can be mounted with the ink discharge orifices directed downwards.

The cartridge garage 1110*b* is formed with a through hole extending fore and back for receiving four ink cartridges 100Y, 100M, 100C, 100Bk, at the same time, and formed with an engagement concave-portion at both end portions outside, which is engaged by an engaging pawl of the cartridge holder 1110*c*.

At the front end portion of the stage 1110*a*, the cartridge holder 1110*c* is rotatably attached by a hinge 1116. The dimension from the front end of the garage 1110*b* to the hinge 1116 can be determined in consideration of the length extending from the front end portion of the garage 1110*b,* when the cartridges 100Y, 100M, 100C, 100Bk are received within the garage 110*b*. The cartridge holder 1110*c* is a plate of substantially rectangular shape. The cartridge holder 110*c* is provided with a pair of engaging pawls 1110*e*, extending orthogonally to the surface of plate, for engaging the engagement concave portion 1110*d* of the garage 1110*b* when closed, at both upper side portions remote from the lower ends attached by the hinges 1116.

Also, the holder 1110*c* is formed with a fitting hole 1120 for fitting a lug portion of each cartridge 100Y, 100M, 100C, 100Bk on the plate portion. This fitting hole 1120 is formed at a position and in shape and size corresponding to the lug portion.

As above described, a replaceable type ink-jet ink cartridge can be produced with very small number of components, with lower costs, and with sufficient high performance maintained, while meeting the demands for larger capacity and more complicate shape, through a quite simple manufacturing process, as well as solving the problem of user handling.

In particular, the ink tank in sheet nature has been enhanced in reliability, with the ink supply ability, negative pressure characteristics and the storage ability also improved.

A package for use in the physical distribution by containing the ink tank cartridge of the form as shown in FIGS. 1A through 2 will be described below.

Figure 29:
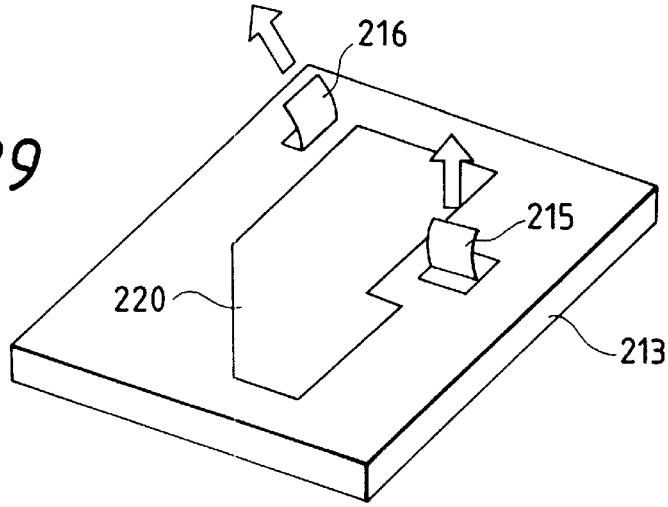
FIG. 29 is a perspective view showing a packaging box in a first practical form of the present invention.
Figure 30:
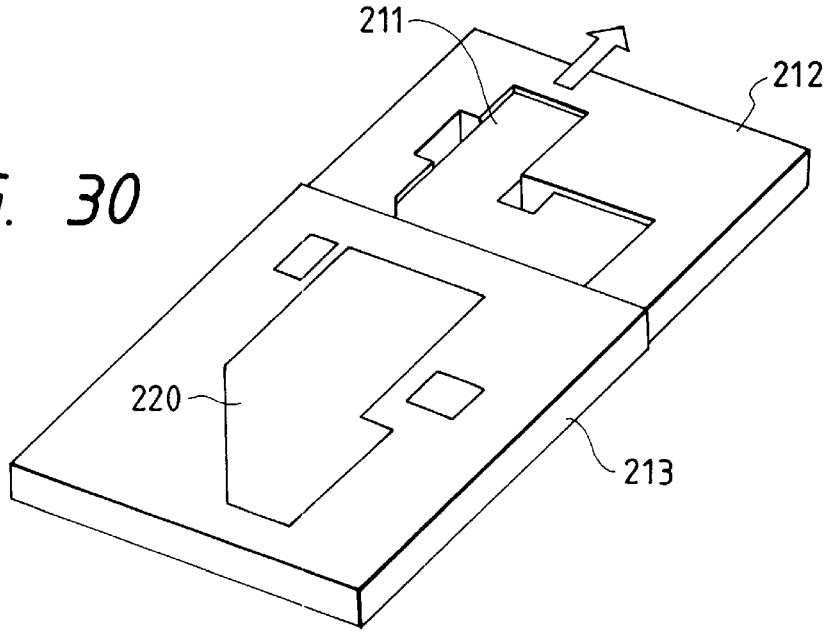
FIG. 30 is a perspective view of the packaging box as shown in FIG. 29, when an inner box is drawn out of an outer box.
Figure 31:
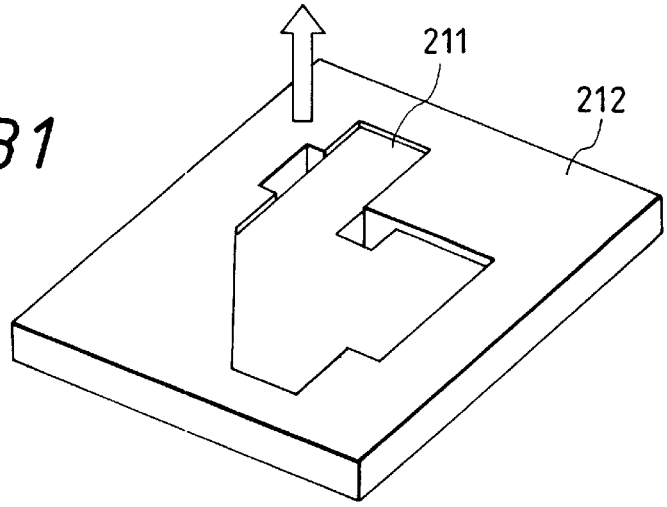
FIG. 31 is a perspective view of the inner box as shown in FIG. 30.

FIGS. 29, 30 and 31 represent characteristically a way of unsealing an ink packaging box in due order. First, seal members 215, 216 for sealing the ink supply port and the atmosphere communication opening of the ink tank are pulled out upward to release the inside of ink tank to the atmosphere, as shown in FIG. 29, then an inner box 212 is drawn out from an outer box 213, as shown in FIG. 3, and finally, the ink tank can be taken out of the package box, as shown in FIG. 31.

Figure 32A:
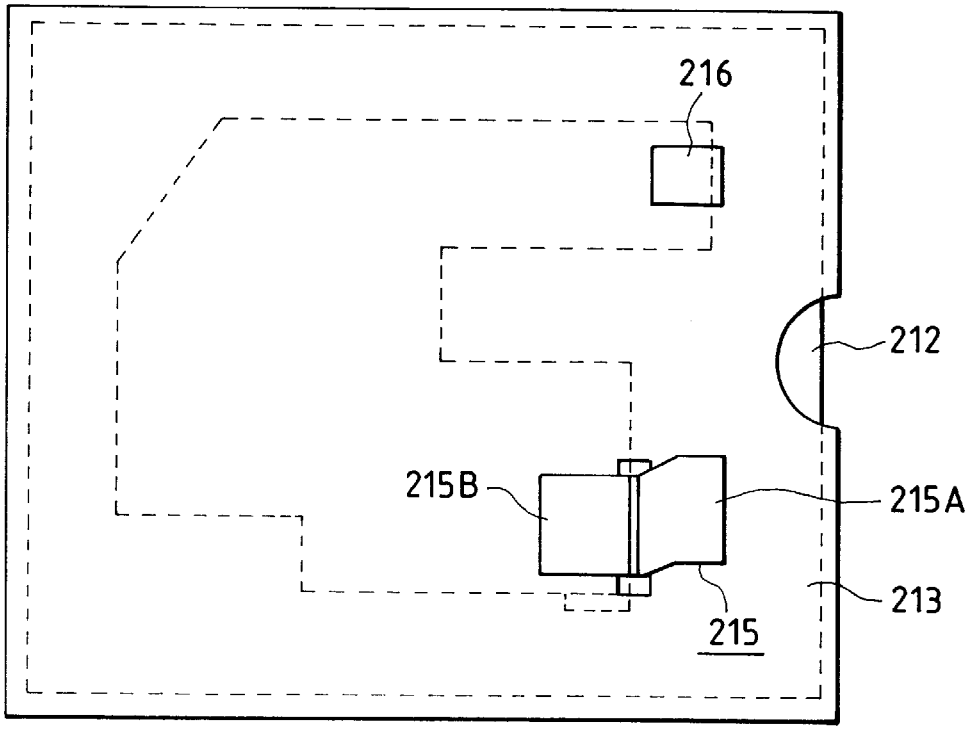
FIG. 32A is a plan view of the packaging box as shown in FIG. 29.
Figure 32B:
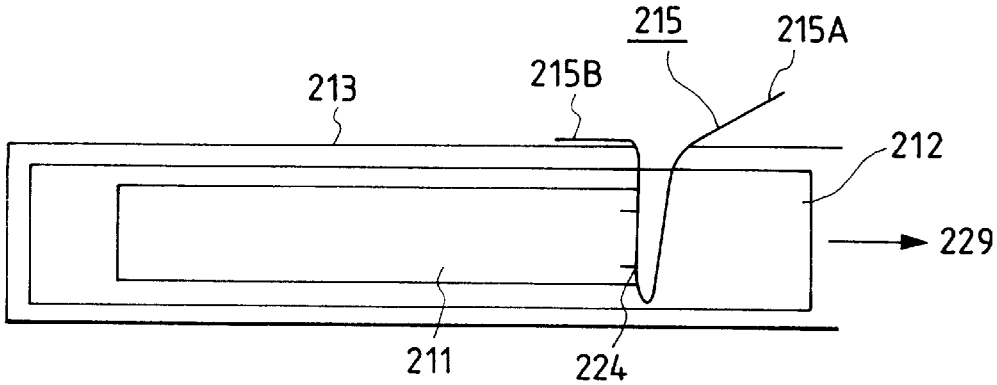
FIG. 32B is a transverse cross-sectional view thereof.
Figure 33:
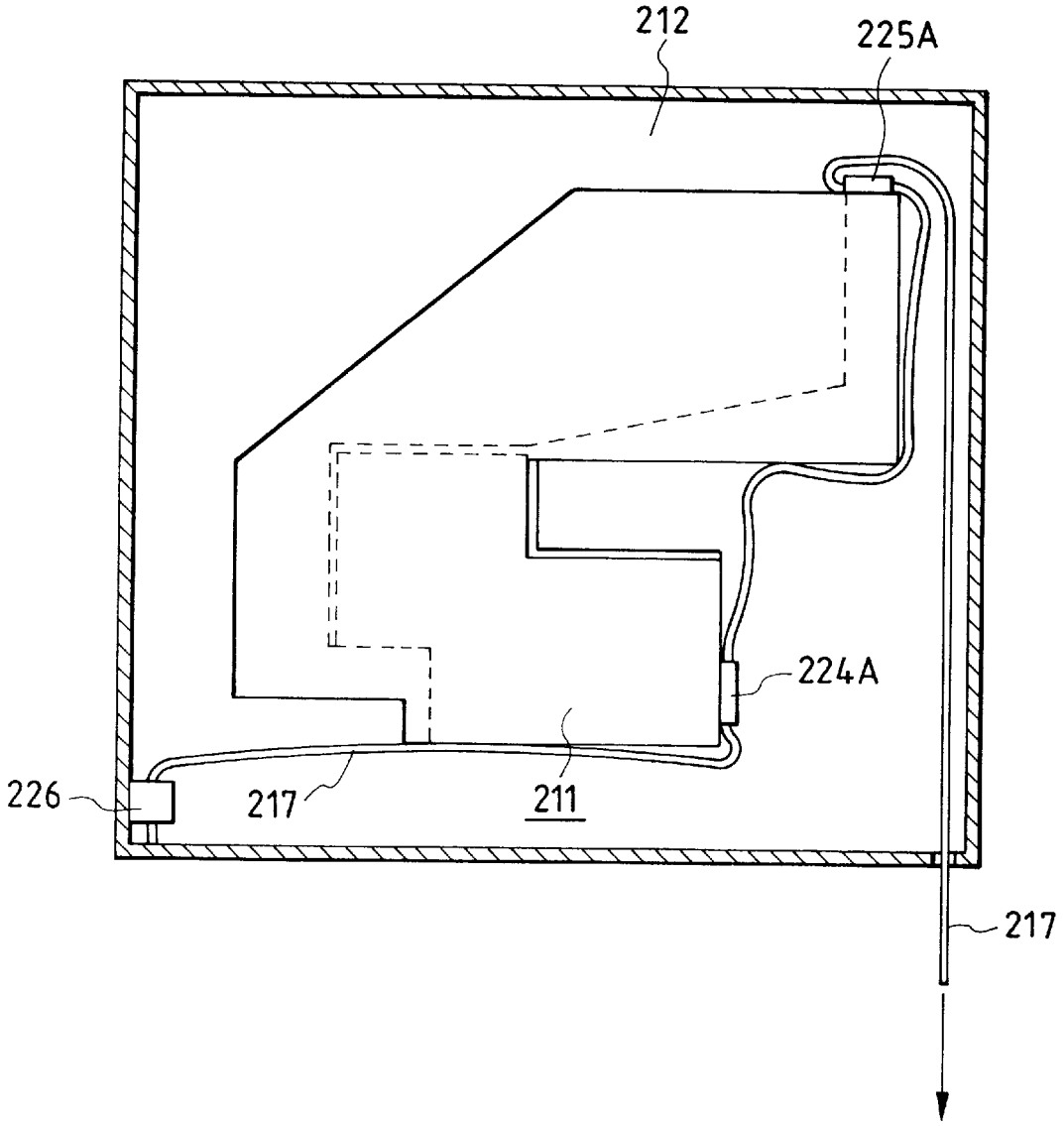
FIG. 33 is a longitudinal cross-sectional view showing another example of a seal member in the packaging box as shown in FIG. 29.

FIGS. 32A through 33 illustrate a mechanism for opening the package.

The ink tank 211 is accommodated within a twofold package box. That is, the inner box 222 is drawn out in a direction of the arrow 229 in the figure, and then the ink tank 211 is taken out from the inner box 212, as shown in FIG. 31. The ink supply port 224 of the ink tank 211 is enclosed with an ink supply port seal member 215. The ink supply port seal member 215 is received within the inner box 212 in folded state on the bottom face of the inner box 212. By pulling up a folded end portion 215A for the ink supply port seal member 215, a force in thrust direction can be applied at the welded part between the ink supply port seal member 215 and the ink supply port 224 of the ink tank 211. An end portion 215B of the seal 215 has been taken out through a hole of the outer box 213 oppositely to the direction of drawing out the inner box 213, and bonded to the outer face of the outer box 213. Also, an end portion 215A of the ink supply port seal member 215 has been also taken out through a hole of the outer box 213. Also, the ink tank 211 can be simply taken out from the inner box 212, but appropriately secured without looseness, when contained.

If the inner box 212 is drawn out in the drawing direction without peeling off the ink supply port seal member 215, the ink supply port seal member 215 can not be instantly peeled off from the supply port 224 of the ink tank, due to a thrust force exerted between the ink supply port 224 of the ink tank 211 and the ink supply port seal member 215. Also, the same force will be also applied by the welded part between the ink supply port seal member 215 and the outer box 213, such that the inner box 212 can not be drawn out of the outer box 213, unless the seal member 215 is peeled off by pulling up the support portion 215A vertically to the direction 229 to peel off the ink supply port seal member 215.

In such a case, since the user may break the box, the outer box 213 is laminated to prevent rupture by the user.

When the sealing of atmosphere communication opening and the ink supply port is provided in the ink tank, it is desirable that the ink supply port is unsealed after the atmosphere communication opening is open to the atmosphere.

FIG. 33 shows a constitution for coping with such problem. That is, the seal member 217 is made integral with the atmosphere communication opening and the ink supply port, and partly taken out of the package material 219, as shown in the same figure. With such a construction, the operation of pulling out the seal member 217 allows the atmosphere communication opening and the ink supply port to be unsealed in succession. Also, the same effect can be obtained by bonding clamp potion 226 to the outer box 226, as shown in the same figure.

Figure 34A:
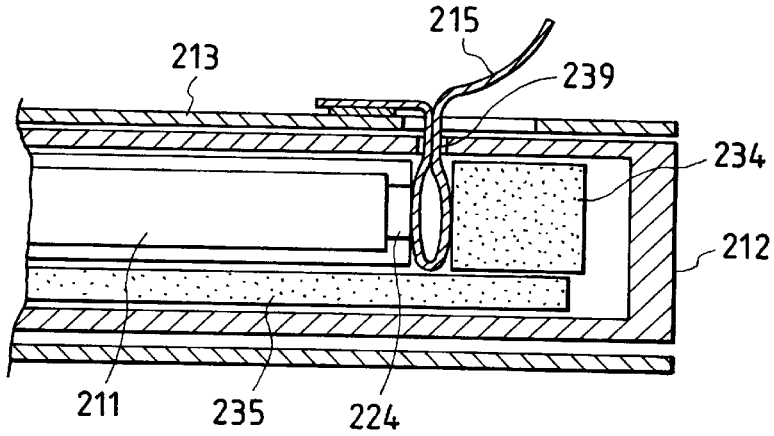
FIGS. 34A and 34B are cross-sectional views of the essence of a packaging box in a second practical form of the present invention.
Figure 34B:
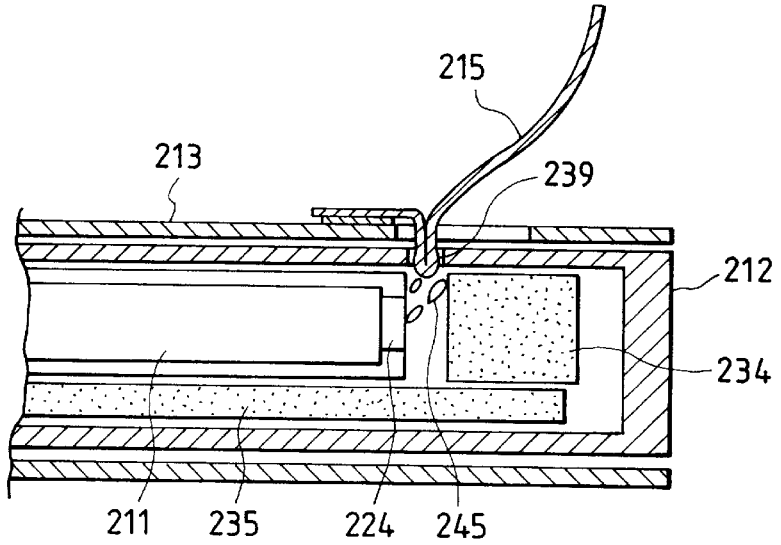

FIGS. 34A and 34B are enlarged cross-sectional views of a portion of seal member 215 for the ink tank in another example of packaging, characteristically representing the action of preventing ink splashing when the seal member 215 is peeled off.

As in the previous example of packaging, the twofold box 212, 213 contains the ink tank 211. This example has the features of the width of a seal member through hole 239 in the packaging inner box 212, and the form of the seal member 215.

That is, by providing a narrower width of the seal member through hole 239 through which the seal member 215 is passed outside the outer and inner boxes, the seal member 215 passed through this hole 239 can be pressed against the cross section of the seal member through hole 239. In particular, the face of the seal member 215 in contact with the inside of ink tank 211 is pressed against the cross section of the seal member through hole 239, with the following effects obtained.

1. If the seal member 215 for the ink supply port 224 is rapidly pulled, as shown in FIG. 36B, the ink collecting in the gap between the seal member 215 and the ink tank 211 is pulled to entrain ink droplets 245 in the movement direction of the seal member 215. In this form, there is no room where ink droplets 245 splash out of the inner box 212, as shown in FIG. 36B, so that ink droplets 245 will remain inside the inner box 212. The collected ink droplets 245 stick to the ink absorbing member 235, ink supply port ink absorbing member 234, the inside of the inner box for packaging, and the inside of the outer box for packaging, and by no way escape outside.

2. Since an ink sticking face of the seal member 215 for the ink supply port 224, namely, a face in contact with the inside of the ink tank 211, is pressed against the cross section of the seal member through hole 239, the cross section of the seal member through hole 239 in contact with it is effective in wiping the ink sticking to the seal member 215, when pulling out the seal member 215.

Figure 35:
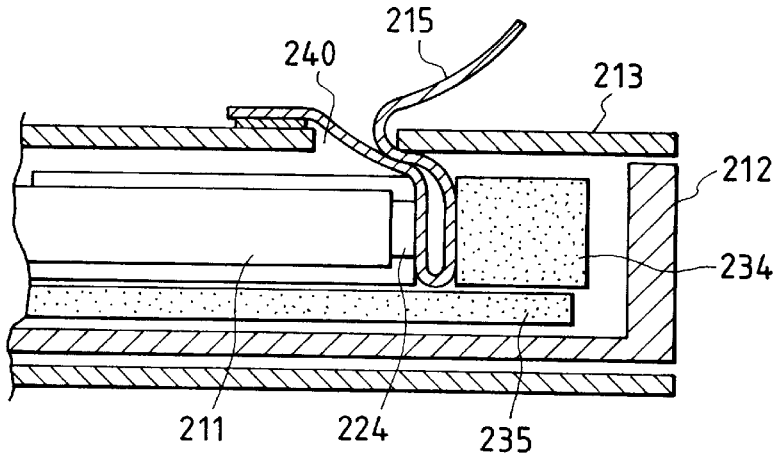
FIG. 35 is a cross-sectional view of the essence of a packaging box in a third practical form of the present invention.

FIG. 35 is an enlarged cross-sectional view of a portion of the seal member 215 for the ink tank 211 in a further packaging form, in which this example has the features of the positional relation between the ink supply port 224 for the ink tank 211 and the seal member through hole 240 for the outer box 213 for packaging, and the form of the seal member 215.

That is, a portion of the ink supply port 224 is covered by the outer box 213, the seal member through hole 240 of the outer box 213 for packaging, as a hole through which the seal member 215 communicates with the outside of the outer box 213, provided on the region not facing the ink supply portion 224. As a result, the same effects as in the previous form can be obtained.

It has been confirmed that the effect of preventing leakage of the ink is increased by combination of the above embodiments. Also, a seal portion of the seal member 216 (see FIG. 29) on the side of atmosphere communication opening can be constituted in the same way as that of the seal member 215 in the above embodiment.

The ink may leak out of the ink tank due to changes in outer air environment or upon impact during the physical distribution, but particularly in an ink tank of the type for containing the ink by means of the negative pressure generating member, while having the chamber for directly containing the ink, an ink tank packaging container suited for unsealing under the condition of varying outer air temperature or pressure, where the ink is collected in the buffer portion of ink tank, or the air is entered into the ink containing portion of ink tank, will be described below.

Figure 36A:
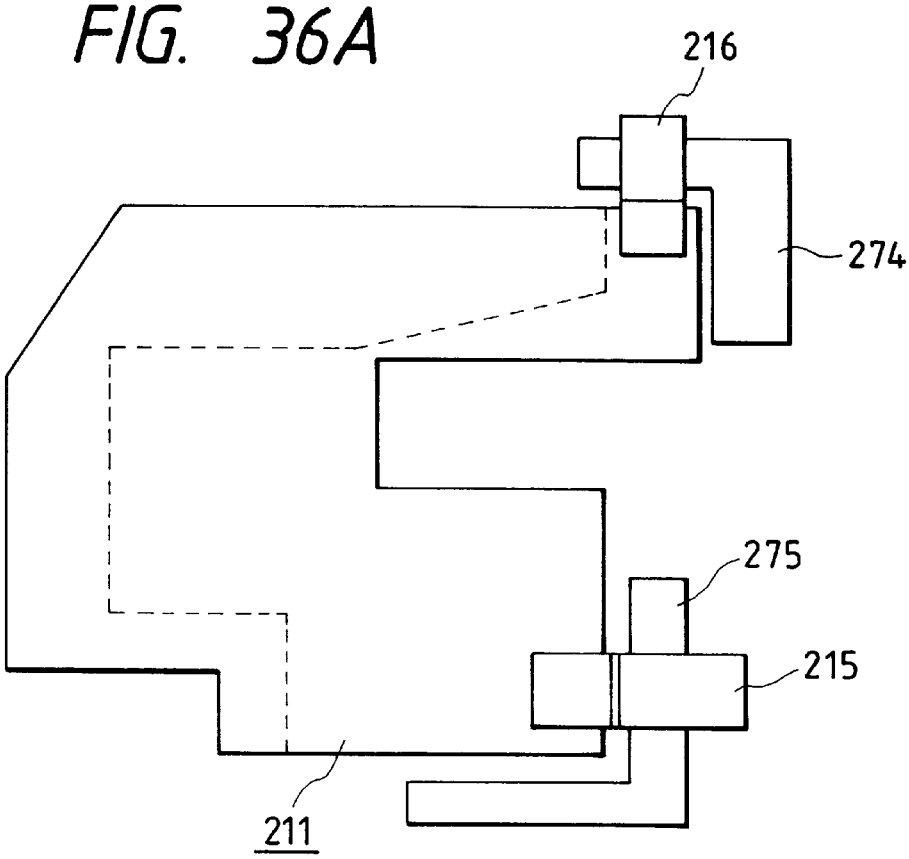
FIG. 36A is an upper view showing a packaging box in a fourth practical form of the invention and FIG. 36B is a side view thereof.
Figure 36B:
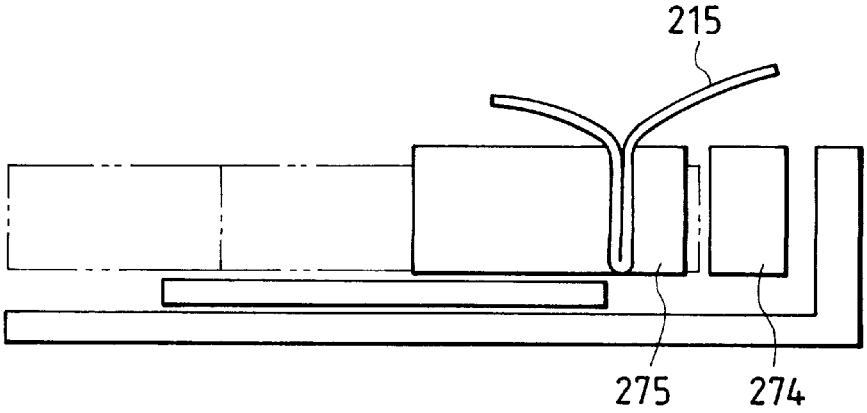

FIGS. 36A and 36B are views showing such container.

As seen in the same figure, the atmosphere communication opening and the ink supply port are enclosed by the seal member 216 and 215 in the form of the ink tank of the type as above described. At opposite positions with the sealing members 215, 216 interposed, ink absorbing members 274 and 275 are disposed.

The ink absorbing members 274 and 275 absorb the ink collecting in the buffer portion of the ink tank in unsealing which may flow back out of the ink supply port. Accordingly, it is necessary to absorb the ink more rapidly than the ink will flow out of the supply port. It is desirable that the ink absorbing rate is higher than the ink flow rate.

The flow rate of the ink from the ink tank 211 can be determined by the constitution (especially, density of absorbing member, height of ink tank) and the ink properties.

Also, the ink absorbing member 275 is disposed between the ink tank and the inner box. The ink absorbing member 275 has the difference between front and back faces in its facial state, one being flat and the other having mesh-like projections. Namely, the area in contact with a flat plane is different between front and back faces. The absorbency of the ink is not changed. A face having smaller contact area is placed on the side of ink tank. Thereby, even if the ink leaks out of the ink supply port or atmosphere communication opening, due to severe physical distribution by some rare accident, in unsealing the seal for the ink tank 211, the ink can be instantly absorbed into three absorbing members. Also, the ink tank 211 is contact with the packaging material, the ink is more difficult to soak into the container box by providing the ink absorbing member on the plane to which the ink drips under the influence of gravity in unsealing, with the less probability of staining the user's hands.

Because the absorbing member provided as above has a small contact area with the ink tank, the ink is difficult to adhere to the ink tank. The ink held in the absorbing member is in stamp state and difficult to transfer onto the ink tank.

Accordingly, in unsealing the ink tank after the severe physical distribution or where there is the significant environmental change, the ink dripping from the ink tank can be also absorbed by the packaging material.

As above described, according to the present invention, three problems concerning the unsealing after physical distribution of the ink tank can be resolved. That is, (1) Unsealing order of ink tank The excellent effects that the ink tank can be taken out without difficulty after unsealing within the box can be exhibited, because the seal member of the ink supply port and the outer box for packaging are pasted.

(2) Ink splash in releasing the seal member

Splashing of ink can be reduced by providing restrictions on the positional relation between the width of the hole through which the seal member and the outer box is drawn out of the outer box and the ink tank.

(3) Dripping ink and sticking ink to the ink tank in unsealing the ink tank after severe physical distribution or under the outer air environmental change.

With the ink absorbing member disposed, and by defining the ink absorbing rate of ink absorbing member and the surface of ink absorbing member, the influence of ink dripping from the ink tank in unsealing can be suppressed to the minimum.

If all the requirements are carried out, the tremendous effect can be exhibited, but if singly implemented, there is superior effect to the conventional form.

What is claimed is:

1. An ink cartridge comprising:

an ink containing portion for containing ink to be supplied to an ink-jet head, the ink containing portion having a partition wall for partitioning into first and second areas, the first area containing an ink holding member for holding ink and being held by said partition wall and an outer wall of the ink cartridge, the first and second areas sharing a communication portion for communicating with each other; and a lid member for covering said ink containing portion, said lid member corresponding to a maximum area surface of the ink cartridge, wherein said lid member is connected to both said outer wall and said partition wall by a vibration welding.

2. An ink cartridge according to claim 1, wherein said ink containing portion includes a communication channel for communicating the ink, and further comprising a negative pressure generating member receiving portion for receiving a negative pressure generating member for absorbing and holding the ink.

3. An ink cartridge according to claim 2, wherein an angle θ between a longitudinal direction of each wall of said ink containing portion and each wall of said negative pressure generating member receiving portion relative to a vibration direction is less than 90°.

4. An ink cartridge according to claim 3, wherein a direction of vibration is multidirectional.

5. A head cartridge comprising an ink cartridge according to claim 3, and an ink-jet head connected to an ink supply port of said ink cartridge, and capable of discharging the ink supplied from said ink supply port through ink discharge orifices.

6. An ink cartridge according to claim 3, wherein said angle θ is less than or equal to 45°.

7. An ink cartridge according to claim 6, wherein a direction of vibration is multidirectional.

8. A head cartridge comprising an ink cartridge according to claim 6, and an ink-jet head connected to an ink supply port of said ink cartridge, and capable of discharging the ink supplied from said ink supply port through ink discharge orifices.

9. An ink cartridge according to claim 2, further comprising at least one member for securing said negative pressure generating member to said negative pressure generating member receiving portion.

10. A head cartridge comprising an ink cartridge according to any one of claims 1 to 9, 6 or 7, and an ink-jet head for recording by being supplied with the ink from said ink cartridge.

11. An ink cartridge according to claim 2, wherein a direction of vibration is multidirectional.

12. An ink cartridge according to claim 2, wherein said wall is provided with wall collapse preventing means for preventing collapse of said wall against said vibration.

13. An ink cartridge according to claim 2, wherein an angle θ between a longitudinal direction of said wall and a vibration direction is less than or equal to 90°, and said wall is provided with wall collapse preventing means for preventing collapse of said wall against said vibration.

14. A head cartridge comprising an ink cartridge according to claim 2, and an ink-jet head connected to an ink supply port of said ink cartridge, and capable of discharging the ink supplied from said ink supply port through ink discharge orifices.

15. An ink cartridge according to claim 1, wherein an angle θ between a longitudinal direction of said wall of said ink containing portion and a vibration direction is less than 90°.

16. An ink cartridge according to claim 15, wherein said angle θ is less than or equal to 45°.

17. An ink cartridge according to claim 16, wherein a direction of vibration is multidirectional.

18. A head cartridge comprising an ink cartridge according to claim 16, and an ink-jet head connected to an ink supply port of said ink cartridge, and capable of discharging the ink supplied from said ink supply port through ink discharge orifices.

19. An ink cartridge according to claim 15, wherein a direction of vibration is multidirectional.

20. A head cartridge comprising an ink cartridge according to claim 15, and an ink-jet head connected to an ink supply port of said ink cartridge, and capable of discharging the ink supplied from said ink supply port through ink discharge orifices.

21. An ink cartridge according to claim 1, wherein a direction of vibration is multidirectional.

22. A head cartridge comprising an ink cartridge according to claim 21, and an ink-jet head connected to an ink supply port of said ink cartridge, and capable of discharging the ink supplied from said ink supply port through ink discharge orifices.

23. An ink cartridge according to claim 1, wherein said wall is provided with wall collapse preventing means for preventing collapse of said wall against said vibration.

24. An ink cartridge according to claim 23, wherein said wall collapse preventing means is comprised of means for fixing to a fixed jig provided on a wall outside said ink containing portion or on said negative pressure generating member receiving portion.

25. An ink cartridge according to claim 23, wherein said wall collapse preventing means relies on a jig to be inserted through an opening of said ink containing portion.

26. A head cartridge comprising an ink cartridge according to claim 23, and an ink-jet head connected to an ink supply port of said ink cartridge, and capable of discharging the ink supplied from said ink supply port through ink discharge orifices.

27. An ink cartridge according to claim 1, wherein an angle θ between a longitudinal direction of said wall and a vibration direction is less than or equal to 90°, and said wall is provided with wall collapse preventing means for preventing collapse of said wall against the vibration.

28. A head cartridge comprising an ink cartridge according to claim 27, and an ink-jet head connected to an ink supply port of said ink cartridge, and capable of discharging the ink supplied from said ink supply port through ink discharge orifices.

29. An ink cartridge according to claim 1, wherein at least said wall of said ink containing portion and said one face of said lid are made of the same material.

30. An ink cartridge according to claim 1, wherein a melting point of a material forming at least the wall of said ink containing portion and that of a material forming said one face of said lid are equal.

31. An ink cartridge according to claim 1, wherein a melting point of a material forming at least the wall of said ink containing portion that of a material forming said one face of said lid are higher than that of a material forming other sections of said ink containing portion.

32. An ink cartridge according to claim 1, wherein said ink containing portion has amplitude suppressing means for suppressing amplitude of said vibration.

33. An ink cartridge according to claim 32, wherein said amplitude suppressing means comprises engagement means provided on said ink containing portion, and engaged means provided on said lid and being engaged by said engagement means.

34. An ink cartridge according to claim 1, further comprising means for screening outer welding burrs produced due to said vibration in welding.

35. An ink cartridge according to claim 1, wherein a welding direction for vibration welding is a direction along a longitudinal direction of the wall to be mainly welded.

36. An ink cartridge comprising:

an ink containing portion for containing ink to be supplied to an ink jet head, the ink containing portion having a partition wall for partitioning into first and second areas, the first area containing an ink holding member for holding ink and being held by said partition wall and an outer wall of the ink cartridge, the first and second areas sharing a communication portion for communicating with each other, wherein at a side facing the second area, the partition wall has a plurality of small ribs orthogonal to said partition wall; and a lid member for covering said ink containing portion, said lid member corresponding to a maximum area surface of the ink cartridge, wherein said lid member is connected to both said outer wall and said partition wall by a vibration welding and said ribs prevent said partition wall from deforming upon vibration welding.

37. An ink cartridge according to claim 36, wherein said ribs are not vibration welded with said lid member.

* * * * *

UNITED STATES PATENT AND TRADEMARK OFFICE

CERTIFICATE OF CORRECTION

PATENT NO. : 6,168,266 B1
DATED : January 2, 2001
INVENTOR(S) : Hiroyuki Ishinaga et al.

It is certified that error appears in the above-identified patent and that said Letters Patent is hereby corrected as shown below:

Column 4,
Line 36, change "scal" to -- seal --.

Column 9,
Line 51, change the second occurrence of "in" to -- ink --.

Column 11,
Line 65, change "reventing" to -- preventing --.

Column 14,
Line 54, change "a" to -- α --.

Column 16,
Line 31, delete "1,".

Column 17,
Line 6, change "ink-Jet" to -- ink-jet --.

Column 21,
Line 66, change "an" to -- and --.

Column 22,
Line 7, change "frequency-of" to -- frequency of --.

Column 33,
Line 20, change "portion" to -- portion and --.

Signed and Sealed this

Thirtieth Day of April, 2002

*Attest:*

*Attesting Officer*

JAMES E. ROGAN
*Director of the United States Patent and Trademark Office*